US010676968B2

(12) United States Patent
Miller et al.

(10) Patent No.: US 10,676,968 B2
(45) Date of Patent: Jun. 9, 2020

(54) SYSTEMS AND METHODS FOR PROVIDING A SECURITY TAG WITH A TELESCOPING ACTUATOR AND/OR ADJUSTABLE RANGE OF INSERT SPACE SIZES

(71) Applicants: Channing E. Miller, Fort Lauderdale, FL (US); Sergio M. Perez, Lake Worth, FL (US); Adam S. Bergman, Boca Raton, FL (US)

(72) Inventors: Channing E. Miller, Fort Lauderdale, FL (US); Sergio M. Perez, Lake Worth, FL (US); Adam S. Bergman, Boca Raton, FL (US)

(73) Assignee: SENSORMATIC ELECTRONICS, LLC, Boca Raton, FL (US)

( * ) Notice: Subject to any disclaimer, the term of this patent is extended or adjusted under 35 U.S.C. 154(b) by 0 days.

(21) Appl. No.: 15/982,936

(22) Filed: May 17, 2018

(65) Prior Publication Data

US 2018/0334836 A1 Nov. 22, 2018

Related U.S. Application Data

(60) Provisional application No. 62/548,863, filed on Aug. 22, 2017, provisional application No. 62/508,283, filed on May 18, 2017.

(51) Int. Cl.
*E05B 73/00* (2006.01)
*G08B 13/24* (2006.01)
(Continued)

(52) U.S. Cl.
CPC ..... *E05B 73/0064* (2013.01); *E05B 73/0017* (2013.01); *E05B 73/0052* (2013.01);
(Continued)

(58) Field of Classification Search
CPC .. E05B 41/00; E05B 73/0017; E05B 73/0023; E05B 73/0041; E05B 73/0052;
(Continued)

(56) References Cited

U.S. PATENT DOCUMENTS 3,715,548 A * 2/1973 Schadow ..... H01H 9/16 200/311
5,068,641 A * 11/1991 Hogen Esch ..... E05B 73/0017 340/551
(Continued)

FOREIGN PATENT DOCUMENTS

FR 3017152 A1 * 8/2015 ..... E05B 73/0017

*Primary Examiner* — Stephen R Burgdorf
(74) *Attorney, Agent, or Firm* — Arent Fox LLP

(57) ABSTRACT

Systems and methods for operating a tag. The methods comprise: actuating a telescoping actuator of the tag to transition a pin from an unengaged position in which the pin is retracted into a first portion of the tag's housing to an engaged position in which the pin extends through an insert space and into a second portion of the tag's housing; and mechanically securing the pin in the engaged position using a securement mechanism disposed in the second portion of the tag's housing. The pin is securely coupled to a movable component of the telescoping actuator so as to be integrated into the tag's body, and the first and second portions of the tag's housing are coupled to each other so as to form a unitary piece.

15 Claims, 19 Drawing Sheets

(51) Int. Cl.
*E05B 15/04* (2006.01)
*E05B 41/00* (2006.01)

(52) U.S. Cl.
CPC ..... *G08B 13/2434* (2013.01); *E05B 41/00* (2013.01); *E05B 2015/0472* (2013.01)

(58) Field of Classification Search
CPC ..... E05B 73/0064; E05B 2015/0472; G01V 15/00; G08B 13/2428; G08B 13/2431; G08B 13/2434; G08B 13/2448
USPC ..... 340/572.1
See application file for complete search history.

(56) References Cited

U.S. PATENT DOCUMENTS

| | | | | |
|---|---|---|---|---|
| 5,426,419 | A | 6/1995 | Nguyen et al. | |
| 6,625,972 | B1 * | 9/2003 | Sternberger | F02K 1/76 239/265.29 |
| 7,821,403 | B2 | 10/2010 | Hogan et al. | |
| 2004/0100385 | A1 * | 5/2004 | Hansen | E05B 73/0017 340/572.9 |
| 2004/0237267 | A1 * | 12/2004 | Copen | E05B 73/0017 24/704.1 |
| 2006/0070410 | A1 * | 4/2006 | Fuss | E05B 73/0017 70/57.1 |
| 2016/0258192 | A1 * | 9/2016 | Bouan | E05B 73/0017 |
| 2017/0193777 | A1 * | 7/2017 | Sayegh | G08B 13/2465 |
| 2018/0025602 | A1 * | 1/2018 | Necchi | E05B 73/0017 340/572.8 |
| 2018/0197391 | A1 * | 7/2018 | Luo | G08B 13/2434 |
| 2018/0291652 | A1 * | 10/2018 | Piccoli | E05B 73/0017 |

* cited by examiner

SYSTEMS AND METHODS FOR PROVIDING A SECURITY TAG WITH A TELESCOPING ACTUATOR AND/OR ADJUSTABLE RANGE OF INSERT SPACE SIZES

CROSS-REFERENCE TO RELATED APPLICATIONS

This application claims priority to U.S. Provisional Patent Application 62/508,283 filed on May 18, 2017 and U.S. Provisional Patent Application 62/548,863 filed on Aug. 22, 2017, the disclosures of which are hereby incorporated by reference.

BACKGROUND

Statement of the Technical Field

The present disclosure relates generally to security tag based systems. More particularly, the present disclosure relates to implementing systems and methods for providing a security tag with a telescoping actuator, an integrated retractable pin and/or an adjustable range of insert space sizes.

Description of the Related Art

A typical Electronic Article Surveillance ("EAS") system in a retail setting may comprise a monitoring system and at least one security tag or label attached to an article to be protected from unauthorized removal. The monitoring system establishes a surveillance zone in which the presence of security tags and/or labels can be detected. The surveillance zone is usually established at an access point for the controlled area (e.g., adjacent to a retail store entrance and/or exit). If an article enters the surveillance zone with an active security tag and/or label, then an alarm may be triggered to indicate possible unauthorized removal thereof from the controlled area. In contrast, if an article is authorized for removal from the controlled area, then the security tag and/or label thereof can be deactivated and/or detached therefrom. Consequently, the article can be carried through the surveillance zone without being detected by the monitoring system and/or without triggering the alarm.

The security tags may be reusable, and thus include releasable attachment devices for affixing the security tags to the articles. Such attachment devices are further designed to be releasable by authorized personnel only so that unauthorized removal of the security tags from their articles can be avoided. To this end, many attachment devices are made releasable only through the use of an associated special hook or detaching mechanism.

An exemplary security tag employing an attachment device and an associated detacher is described in U.S. Pat. No. 5,426,419 ("the '419 patent"), entitled SECURITY TAG HAVING ARCUATE CHANNEL AND DETACHER APPARATUS FOR SAME and assigned to the same assignee hereof. The security tag of the '419 patent includes a tag body and an attachment element or device in the form of a tack assembly. The tack assembly is used to attach the tag body to an article which is to be protected by the security tag. This is accomplished by inserting a tack into an opening in the tag body. When the tack is fully inserted into the opening, it is releasably secured in the tag body via a releasable locking means. Access to the releasable locking means is through an arcuate channel. With this configuration, a special arcuate probe is needed to reach and release the releasable locking means, and thus detach the security tag from the article.

SUMMARY

The present disclosure generally concerns implementing systems and methods for operating a tag. The methods comprise: actuating a telescoping actuator of the tag to transition a pin from an unengaged position in which the pin is retracted into a first portion of the tag's housing to an engaged position in which the pin extends through an insert space and into a second portion of the tag's housing; and mechanically securing the pin in the engaged position using a securement mechanism disposed in the second portion of the tag's housing. The pin is securely coupled to a movable component of the telescoping actuator so as to be integrated into the tag's body. The first and second portions of the tag's housing are coupled to each other so as to form a unitary piece. The telescoping actuator has a decreased size when the pin is in the engaged position.

In some scenarios, the telescoping actuator has a dual purpose of (A) transitioning the pin between the engaged and unengaged positions and (B) providing a visual indication of a state of the pin's mechanical securement. The visual indication is at least partially provided by a marking or texture applied to the telescoping actuator.

At least a portion of the telescoping actuator is reliantly biased in a direction away from the tag's housing. In this regard, the telescoping actuator automatically transitions from an actuated position to an unactuated position by a resilient member when the pin is released from the securement mechanism.

A size of the insert space can be adjusted while the tag is being coupled to an article. The size of the insert space is selectively adjusted by: moving a portion of the telescoping actuator into the insert space; and/or moving the first portion of the tag's housing relative to the second portion of the tag's housing. A shoulder portion coupled to the telescoping actuator may be moved into the insert space for protecting the pin.

BRIEF DESCRIPTION OF THE DRAWINGS

The present solution will be described with reference to the following drawing figures, in which like numerals represent like items throughout the figures.

DETAILED DESCRIPTION

Figure 1:
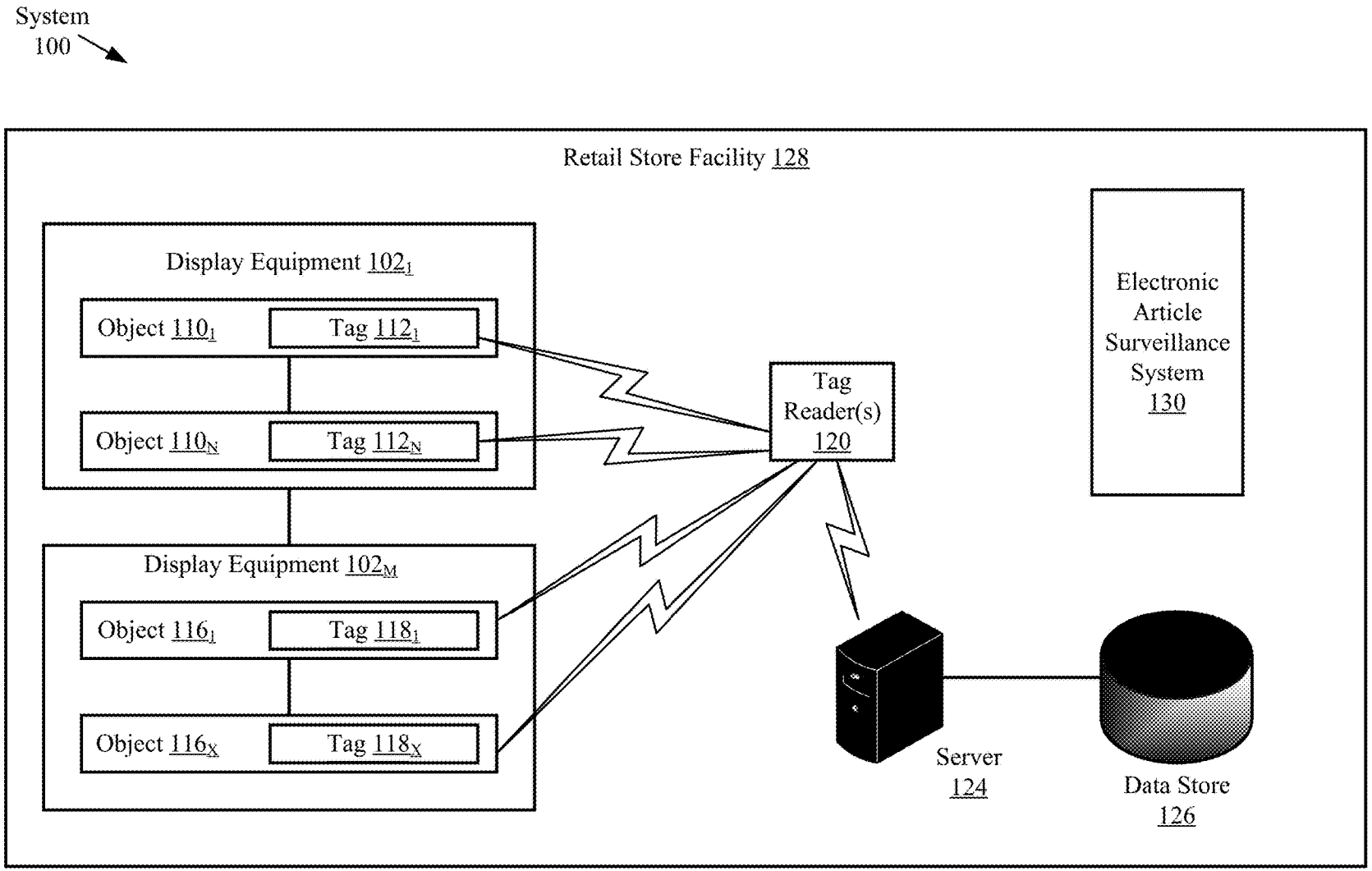
FIG. 1 is an illustration of an illustrative architecture for a system.

It will be readily understood that the components of the embodiments as generally described herein and illustrated in the appended figures could be arranged and designed in a wide variety of different configurations. Thus, the following more detailed description of various embodiments, as represented in the figures, is not intended to limit the scope of the present disclosure, but is merely representative of various embodiments. While the various aspects of the embodiments are presented in drawings, the drawings are not necessarily drawn to scale unless specifically indicated.

The present solution may be embodied in other specific forms without departing from its spirit or essential characteristics. The described embodiments are to be considered in all respects only as illustrative and not restrictive. The scope of the present solution is, therefore, indicated by the appended claims rather than by this detailed description. All changes which come within the meaning and range of equivalency of the claims are to be embraced within their scope.

Reference throughout this specification to features, advantages, or similar language does not imply that all of the features and advantages that may be realized with the present solution should be or are in any single embodiment of the present solution. Rather, language referring to the features and advantages is understood to mean that a specific feature, advantage, or characteristic described in connection with an embodiment is included in at least one embodiment of the present solution. Thus, discussions of the features and advantages, and similar language, throughout the specification may, but do not necessarily, refer to the same embodiment.

Furthermore, the described features, advantages and characteristics of the present solution may be combined in any suitable manner in one or more embodiments. One skilled in the relevant art will recognize, in light of the description herein, that the present solution can be practiced without one or more of the specific features or advantages of a particular embodiment. In other instances, additional features and advantages may be recognized in certain embodiments that may not be present in all embodiments of the present solution.

Reference throughout this specification to "one embodiment", "an embodiment", or similar language means that a particular feature, structure, or characteristic described in connection with the indicated embodiment is included in at least one embodiment of the present solution. Thus, the phrases "in one embodiment", "in an embodiment", and similar language throughout this specification may, but do not necessarily, all refer to the same embodiment.

As used in this document, the singular form "a", "an", and "the" include plural references unless the context clearly dictates otherwise. Unless defined otherwise, all technical and scientific terms used herein have the same meanings as commonly understood by one of ordinary skill in the art. As used in this document, the term "comprising" means "including, but not limited to".

Despite the advantages of the security tag architecture described in the background section of this document, it suffers from certain drawbacks. Typically, security tags are manufactured as two separate parts, namely a tack (pin) and a tag body. Items (e.g., garments) are sandwiched or clamped between the tack head and the tag body to provide the security feature. When items are successfully purchased at the point of sale, the tack is separated from the tag body by a tag detaching mechanism. At this point, the tack and tag body can be separately reclaimed by the retailer for future use. The problem with this solution is that when a two-part tag is used in a retail environment, the following may occur: the tack with an exposed pin becomes loose and misplaced during the tag detachment procedure performed by store personnel; and an exposed tack can be lost in the retail store due to an unauthorized person defeating of the tag (e.g., a tack is forcibly removed from the tag body by unauthorized persons and left in a dressing room). Both of these scenarios create risk of injury to retail store customers and employees. Loose tacks pose safety issues, especially in the area of children's clothing. In some countries, retailers are legally prohibited from using security tags which include a tack portion with an exposed pin.

Accordingly, the present solution generally concerns implementing systems and methods for providing an improved tag. The tag comprises a unitary piece with a retractable pin. The retractable pin is integrated into the body of the tag. Since the pin is integrated into the tag body, it may have a sharper point at its free end as compared to that of conventional pin-based tags. As such, the present solution can be used with a more refined product since the pin would cause minimal marking if delicate materials with tagging. A locking means selectively prevents unauthorized detachment of the tag from an article. The locking means can include, but is not limited to, a clamp mechanism for retaining the pin in a locked position. An illustrative clamp mechanism is described in U.S. Pat. No. 7,821,403 ("the '403 patent"), entitled MAGNETICALLY RELEASABLE GROOVED TACK CLUTCH FOR REUSABLE AND NON-REUSABLE APPLICATIONS and assigned to the same assignee hereof.

The tag is attached to an article by urging the retractable pin assembly downward so that the sharp end of pin portion protrudes from an aperture in the tag. The retractable pin assembly can include, but is not limited to, a manually-actuated spring biased pushbutton which is configured to urge the pin through the aperture. The tag body, retractable pin assembly, and locking aperture are configured and arranged to maintain the sharp end of the pin in a safe position at all times to prevent external exposure of the sharp end of the pin. To accomplish this, the opening provided for sliding insertion of a portion of material is narrow enough to prevent human fingers from accidentally entering the area proximate the pin. The extended pin is received in a cooperating locking aperture in the tag body, and secured therein using the locking means.

The tag is configured to provide an article insertion opening having an adjustable range of action in order to accommodate a specific range of material thickness. In one scenario, an upper portion of the tag body is movable with respect to the lower portion of the tag body so as to provide an article insertion opening with a varying and selectable height. For example, the distance between the upper and lower portions of the tag body can be adjusted to be larger if a relatively thick piece of material is to be inserted. Conversely, this distance can be decreased to accommodate very thin items (e.g., fabrics). This adjustable feature ensures that the pin shank is never visible after the tag is attached. It also ensures that the garment is not damaged, since the material is held snugly between the upper and lower portions of the tag body, preventing the pin shank from possibly tearing of the item (e.g., fabric).

To release the pin from the locking aperture, an external tool is guided into a channel formed within the tag for releasing the retractable pin assembly from the securement member. Additionally or alternatively, a magnetic field can be applied to the security tag so as to facilitate the transition a pin securement member or any other cooperating locking element to an unlocking position.

The security tag advantageously limits the opportunities to defeat the same. Typical defeat modes for prior art tags include efforts to separate the tack from the tag body. Since the pin in the tag disclosed herein is integral to the tag body, the defeat resistance is dramatically improved.

The tag significantly improves usability for application to an article in numerous ways. Because the pin/tack is integral to the tag, instead of managing a separate pin, the user only needs to depress a button to attach or actuate the pin. The spring-biased button can provide audible, visual and/or tactile feedback that the pin has been fully depressed and the garment is now protected by the tag.

The tag advantageously increases safety both for users who attached the tags and others who might encounter the tag in an unattached stated. Since the pin is integral to the tag body, the issue of possible injury due to an exposed pin is eliminated.

The tag disclosed herein also significantly improves usability for automatic detaching arrangements. The new tag design does not require any interpretation of when the item (e.g., garment) is ready for removal when automatically detaching. The pin is not required to be separately removed within a specified dwell time. Once the detacher hook releases the clamp, the user gets obvious visual and audible feedback that the detaching process has completed (e.g., pin will retract within housing automatically to provide easy removal of the garment).

Illustrative Systems

Referring now to FIG. 1, there is provided an illustration of an illustrative system 100 that is useful for understanding the present solution. The present solution is described herein in relation to a retail store environment. The present solution is not limited in this regard, and can be used in other environments. For example, the present solution can be used in distribution centers, factories and other commercial environments. Notably, the present solution can be employed in any environment in which objects and/or items need to be located and/or tracked.

The system 100 is generally configured to facilitate inventory counts and security of objects within a facility. As shown in FIG. 1, system 100 comprises a Retail Store Facility ("RSF") 128 in which display equipment $\mathbf{102}_1, \ldots, \mathbf{102}_M$ (collectively referred to as "102") is disposed. The display equipment is provided for displaying objects (or items) $\mathbf{110}_1$-$\mathbf{110}_N$ (collectively referred to as "110"), $\mathbf{116}_1$-$\mathbf{116}_X$ (collectively referred to as "116") to customers of the retail store. The display equipment can include, but is not limited to, shelves, article display cabinets, promotional displays, fixtures and/or equipment securing areas of the RSF 128. The RSF can also include emergency equipment (not shown), checkout counters and an EAS system (not shown). Emergency equipment, checkout counters, and EAS systems are well known in the art, and therefore will not be described herein.

At least one tag reader 120 is provided to assist in counting and/or locating the objects 110, 116 within the RSF 128. The tag reader 120 comprises an RFID reader configured to read RFID tags. RFID tags $\mathbf{112}_1$-$\mathbf{112}_N$ (collectively referred to as "112"), $\mathbf{118}_1$-$\mathbf{118}_X$ (collectively referred to as "118") are respectively attached or coupled to the objects 110, 116. The RFID tags are described herein as comprising single-technology tags that are only RFID enabled. The present solution is not limited in this regard. The RFID tags can alternatively or additionally comprise Electronic Article Surveillance ("EAS") tags, or dual-technology tags that have both EAS and RFID capabilities. EAS tag technology is well known in the art, and therefore will not be described herein. Any known or to be known EAS tag technology can be used herein without limitation.

Notably, the tag reader 120 is strategically placed at a known location within the RSF 128. By correlating the tag reader's RFID tag reads and the tag reader's known location within the RSF 128, it is possible to determine the location of objects 110, 116 within the RSF 128. The tag reader's known coverage area also facilitates object location determinations. Accordingly, RFID tag read information and tag reader location information is stored in a data store 126. This information can be stored in the data store 126 using a server 124. Tag readers, servers and data stores are well known in the art, and therefore will not be described herein.

An EAS system 130 is also provided in the RSF 128. EAS systems are well known in the art, and therefore will not be described herein. Any known or to be known EAS system can be employed herein without limitation.

Figure 2:
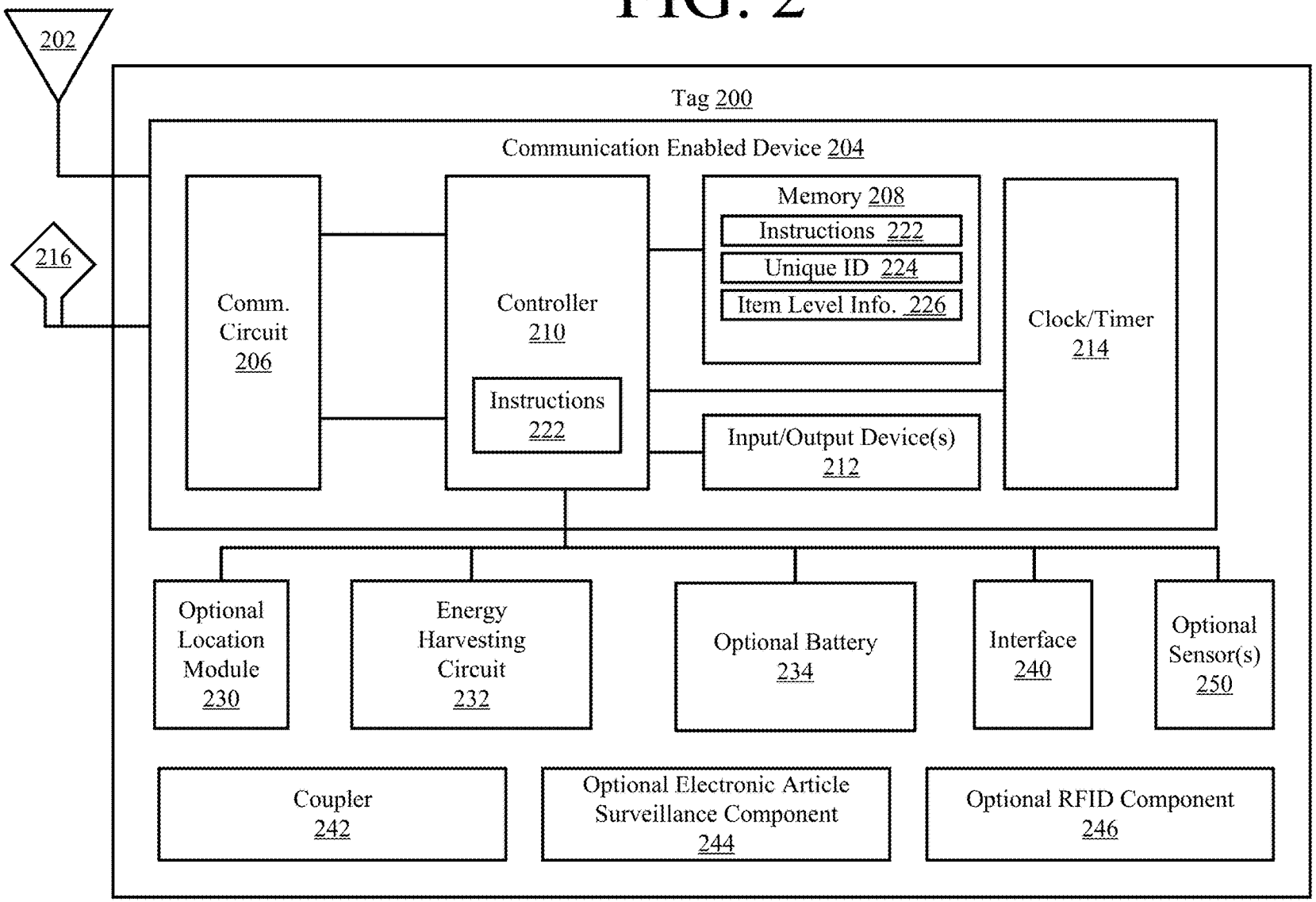
FIG. 2 provides an illustration of an illustrative architecture for a tag.
Figure 3:
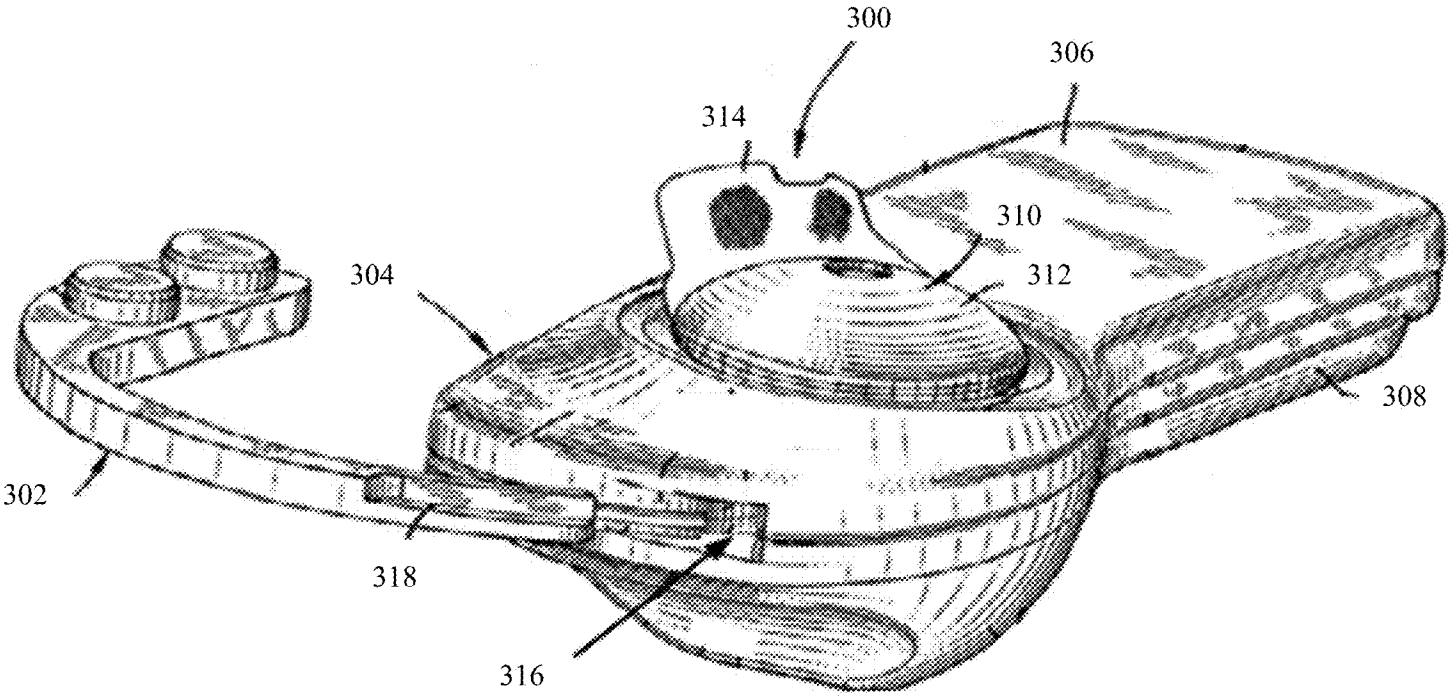
FIG. 3 (Prior Art)
FIGS. 3-4 provide an illustration of an illustrative architecture for a conventional tag.
Figure 4:
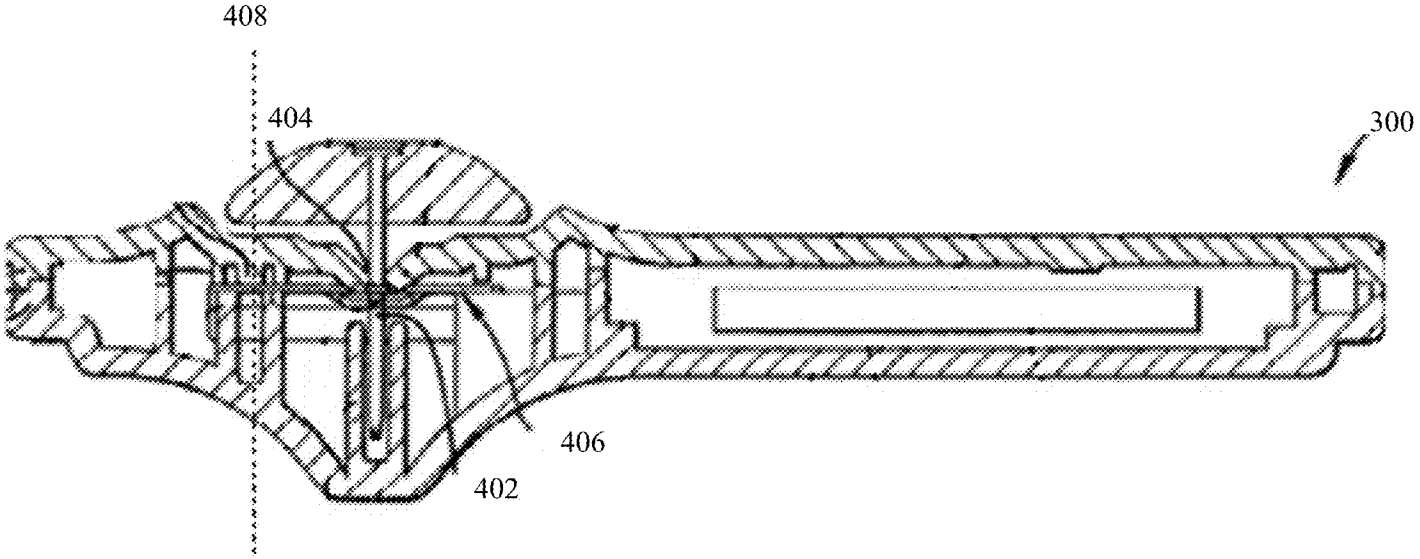
FIG. 4 (Prior Art)

Referring now to FIG. 2, there is an illustration of an illustrative architecture for a tag 200. Tags 112, 118 are the same as or similar to tag 200. As such, the discussion of tag 200 is sufficient for understanding the tags 112, 118 of FIG. 1.

The tag 200 can include more or less components than that shown in FIG. 2. However, the components shown are sufficient to disclose an illustrative embodiment implementing the present solution. Some or all of the components of the tag 200 can be implemented in hardware, software and/or a combination of hardware and software. The hardware includes, but is not limited to, one or more electronic circuits. The electronic circuit(s) may comprise passive components (e.g., capacitors and resistors) and active components (e.g., processors) arranged and/or programmed to implement the methods disclosed herein.

The hardware architecture of FIG. 2 represents a representative tag 200 configured to facilitate inventory management and object security. In this regard, the tag 200 is configured for allowing data to be exchanged with an external device (e.g., tag reader 120 of FIG. 1 and/or server 124 of FIG. 1) via wireless communication technology. The wireless communication technology can include, but is not limited to, a Radio Frequency Identification ("RFID") technology, a Near Field Communication ("NFC") technology, and/or a Short Range Communication ("SRC") technology. For example, one or more of the following wireless communication technologies (is) are employed: Radio Frequency ("RF") communication technology; Bluetooth technology; WiFi technology; beacon technology; and/or LiFi technology. Each of the listed wireless communication technologies is well known in the art, and therefore will not be described in detail herein. Any known or to be known wireless communication technology or other wireless communication technology can be used herein without limitation.

The components 206-214 shown in FIG. 2 may be collectively referred to herein as a communication enabled device 204, and include a memory 208 and a clock/timer 214. Memory 208 may be a volatile memory and/or a non-volatile memory. For example, the memory 208 can include, but is not limited to, Random Access Memory ("RAM"), Dynamic RAM ("DRAM"), Static RAM ("SRAM"), Read Only Memory ("ROM") and flash memory. The memory 208 may also comprise unsecure memory and/or secure memory.

As shown in FIG. 2, the communication enabled device 204 comprises at least one antenna 202, 216 for allowing data to be exchanged with the external device via a wireless communication technology (e.g., an RFID technology, an NFC technology and/or a SRC technology). The antenna 202, 216 is configured to receive signals from the external device and/or transmit signals generated by the communication enabled device 204. The antenna 202, 216 can comprise a near-field or far-field antenna. The antennas include, but are not limited to, a chip antenna or a loop antenna.

The communication enabled device 204 also comprises a communications circuit 206. Communications circuits are well known in the art, and therefore will not be described herein. Any known or to be known communications circuit can be used herein provided that it supports RFID communications. For example, in some scenarios, the communications circuit comprises a transceiver. In other scenarios, the communications circuit comprises a receiver and is configured to provide a backscatter response.

During operation, the communications circuit 206 processes received signals (e.g., RF signals) transmitted from external devices to determine whether it should transmit a response signal (e.g., RF carrier signal) to external devices or provide a backscatter response to the external device. In this way, the communication enabled device 204 facilitates the registration, identification, location and/or tracking of an item (e.g., object 110 or 112 of FIG. 1) to which the tag 200 is coupled.

The communication enabled device 204 also facilitates the automatic and dynamic modification of item level information 226 that is being or is to be output from the tag 200 in response to certain trigger events. The trigger events can include, but are not limited to, the tag's arrival at a particular facility (e.g., RSF 128 of FIG. 1), the tag's arrival in a particular country or geographic region, a date occurrence, a time occurrence, a price change, and/or the reception of user instructions.

Item level information 226 and a unique identifier ("ID") 224 for the tag 200 can be stored in memory 208 of the communication enabled device 204 and/or communicated to other external devices (e.g., tag reader 120 of FIG. 1 and/or server 124 of FIG. 1) via communications circuit 206 and/or interface 240 (e.g., an Internet Protocol or cellular network interface). For example, the communication enabled device 204 can communicate information specifying a timestamp, a unique identifier for an item, item description, item price, a currency symbol and/or location information to an external device. The external device (e.g., server) can then store the information in a database (e.g., database 126 of FIG. 1) and/or use the information for various purposes.

The communication enabled device 204 also comprises a controller 210 (e.g., a CPU) and input/output devices 212. The controller 210 can execute instructions 222 implementing methods for facilitating inventory counts and management. In this regard, the controller 210 includes a processor (or logic circuitry that responds to instructions) and the memory 208 includes a computer-readable storage medium on which is stored one or more sets of instructions 222 (e.g., software code) configured to implement one or more of the methodologies, procedures, or functions described herein. The instructions 222 can also reside, completely or at least partially, within the controller 210 during execution thereof by the tag 200. The memory 208 and the controller 210 also can constitute machine-readable media. The term "machine-readable media", as used here, refers to a single medium or multiple media (e.g., a centralized or distributed database, and/or associated caches and servers) that store the one or more sets of instructions 222. The term "machine-readable media", as used here, also refers to any medium that is capable of storing, encoding or carrying a set of instructions 222 for execution by the tag 200 and that cause the tag 200 to perform any one or more of the methodologies of the present disclosure.

The input/output devices can include, but are not limited to, a display (e.g., an E Ink display, an LCD display and/or an active matrix display), a speaker, a keypad and/or light emitting diodes. The display is used to present item level information in a textual format and/or graphical format. Similarly, the speaker may be used to output item level information in an auditory format. The speaker and/or light emitting diodes may be used to output alerts for drawing a person's attention to the tag 200 (e.g., when motion thereof has been detected) and/or for notifying the person of a particular pricing status (e.g., on sale status) of the item to which the tag is coupled.

The clock/timer 214 is configured to determine a date, a time, and/or an expiration of a pre-defined period of time. Technique for determining these listed items are well known in the art, and therefore will not be described herein. Any known or to be known technique for determining these listed items can be used herein without limitation.

The tag 200 also comprises an optional location module 230. The location module 230 is generally configured to determine the geographic location of the tag at any given time. For example, in some scenarios, the location module 230 employs Global Positioning System ("GPS") technology and/or Internet based local time acquisition technology. The present solution is not limited to the particulars of this example. Any known or to be known technique for determining a geographic location can be used herein without limitation including relative positioning within a facility or structure.

The coupler 242 is provided to securely or removably couple the tag 200 to an item (e.g., object 110 or 112 of FIG. 1). The coupler 242 includes, but is not limited to, a mechanical coupling means (e.g., a retractable pin).

The tag 200 can also include an optional EAS component 244 and/or a passive/active/semi-passive RFID component 246. Each of the listed components 244, 246 is well known in the art, and therefore will not be described herein. Any known or to be known battery, EAS component and/or RFID component can be used herein without limitation.

As shown in FIG. 2, the tag 200 further comprises an energy harvesting circuit 232. In some scenarios, the energy harvesting circuit 232 is configured to harvest energy from at least one energy source (e.g., RFID and/or motion) and to generate output power from the harvested energy. Energy harvesting circuits are well known in the art, and therefore will not be discussed herein. An optional rechargeable battery 234 may also be provided to power the electronic components of the tag.

As noted above, the tag 200 may also include one or more sensors 250. Sensors are well known in the art, and therefore will not be described herein. Any known or to be known sensor can be used herein without limitation. For example, the sensor 250 includes, but is not limited to, a vibration sensor, an accelerometer, a gyroscope, a linear motion sensor, a Passive Infrared ("PIR") sensor, a tilt sensor, a rotation sensor, a temperature sensor, and/or a proximity sensor.

Illustrative Architecture of a Conventional Tag

An illustrative architecture of a conventional tag 300 will now be discussed in relation to FIGS. 3-7. This discussion is useful for understanding certain operations of novel security tags implementing the present solution. These novel security tags can employ the same or similar securement mechanism for securing a pin to a tag body as that employed by the conventional tag 300. Accordingly, the novel security tags can be detached from an object in the same or similar manner as the conventional tag 300 (i.e., via an arcuate probe as discussed below).

Referring now to FIGS. 3-7, there is provided schematic illustrations useful for understanding an illustrative conventional security tag 300. As shown in FIGS. 3-7, the security tag 300 includes a housing 304 with an upper housing member 306 joined to a lower housing member 308. The housing members 306, 308 can be joined together via an adhesive, a mechanical coupling means (e.g., snaps, screws, etc.), or a weld (e.g., an ultrasonic weld). The housing 304 can be made from a rigid or semi-rigid material, such as plastic. The housing 304 has an opening 404 formed therein such that at least a portion of a tack assembly 310 (or attachment element) can be inserted into the security tag for facilitating the attachment of the security tag to an article 314 (e.g., a piece of clothing). EAS and/or RFID components 506 are contained within the housing 304. EAS and RFID components of security tags are well known in the art, and therefore will not be described herein.

Tack assembly 310 has a tack head 312 and an elongate tack body 402 extending down and away from the tack head. The tack body 402 is sized and shaped for insertion into opening 404 and removal from opening 404. A plurality of grooves (not shown in FIGS. 3-7) may be formed along a length of the tack body 402 for engagement with a securement mechanism 406 disposed within the housing 304. When the grooves are engaged by the securement mechanism 406, the security tag 300 is secured to the article 314. Thereafter, unauthorized removal of the article 314 from a controlled area can be detected by a monitoring device of an EAS system. Such monitoring devices are well known in the art, and therefore will not be described herein. Still, it should be understood that at least one sensor (not shown in FIGS. 1-5) is disposed within the housing 304. The sensor includes, but is not limited to, an acoustically resonant magnetic sensor. In all cases, the sensor generates signals which can be detected by the monitoring device.

Such detection occurs when the security tag is present within a surveillance zone established by the monitoring device. The surveillance zone is usually established at an access point for the controlled area (e.g., adjacent to a retail store entrance and/or exit). If the article 314 enters the surveillance zone with the security tag 300, then an alarm may be triggered to indicate possible unauthorized removal thereof from the controlled area. In contrast, if the article 314 is authorized for removal from the controlled area, then the security tag 300 thereof can be deactivated and/or detached therefrom using a detachment mechanism 302 (or external tool). Consequently, the article 314 can be carried through the surveillance zone without being detected by the monitoring system and/or without triggering the alarm.

The detachment mechanism 302 is sized and shaped to at least be partially slidingly inserted into and removed from an insert space 316 formed in the housing 304. When inserted into insert space 316, the detachment mechanism 302 travels through an arcuate channel 502 so as to be guided towards the securement mechanism 406. In this regard, the detachment mechanism 302 has a generally arcuate shape matching that of the arcuate channel 502. Upon engagement with the securement mechanism 406, the detachment mechanism 302 releases the tack body 402 therefrom. Next, the tack body 402 can be removed from the housing, so as to decouple the security tag 300 from the article 314.

Figure 5:
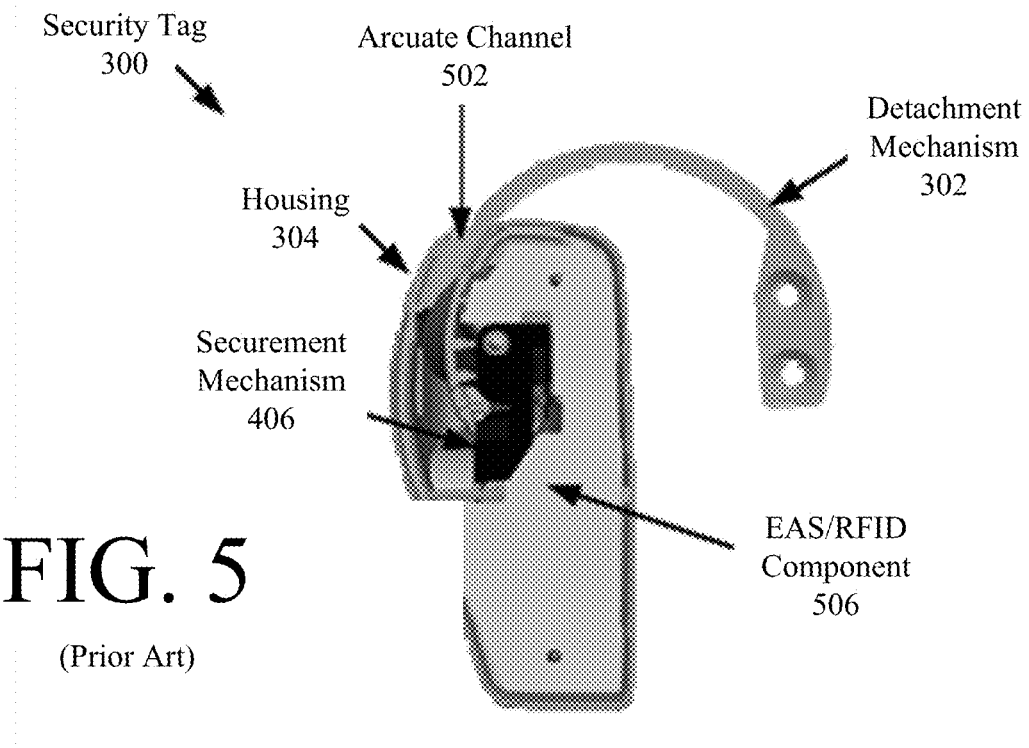
FIG. 5 (Prior Art)
FIG. 5 is an illustration of the conventional security tag shown in FIGS. 3-4 in an locked position.
Figure 6:
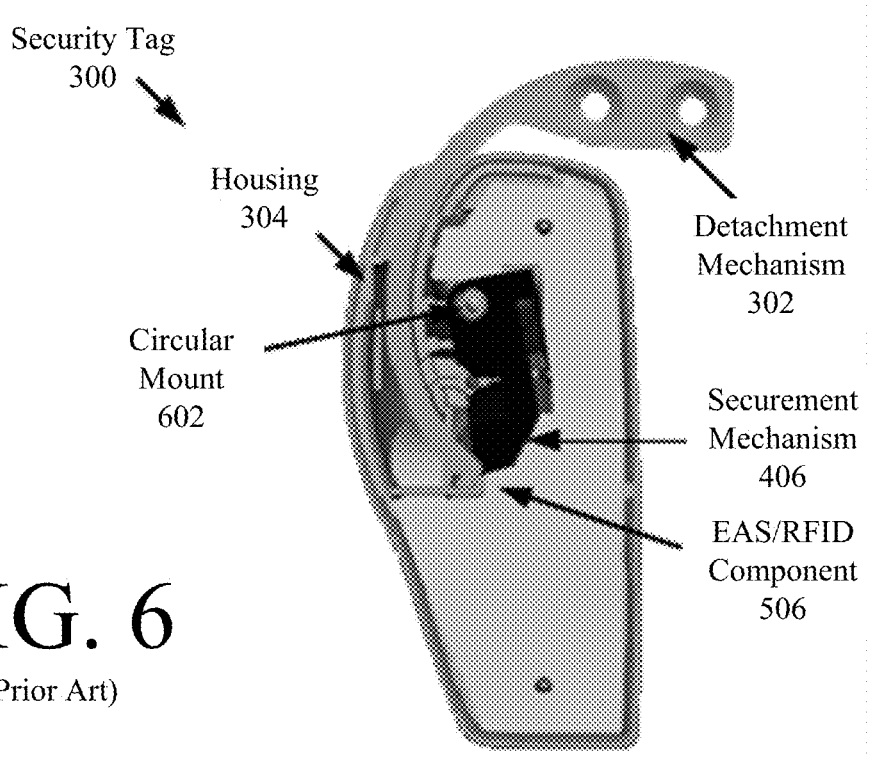
FIG. 6 (Prior Art)
FIG. 6 is an illustration of the conventional security tag shown in FIGS. 3-4 in an unlocked position.
Figure 7:
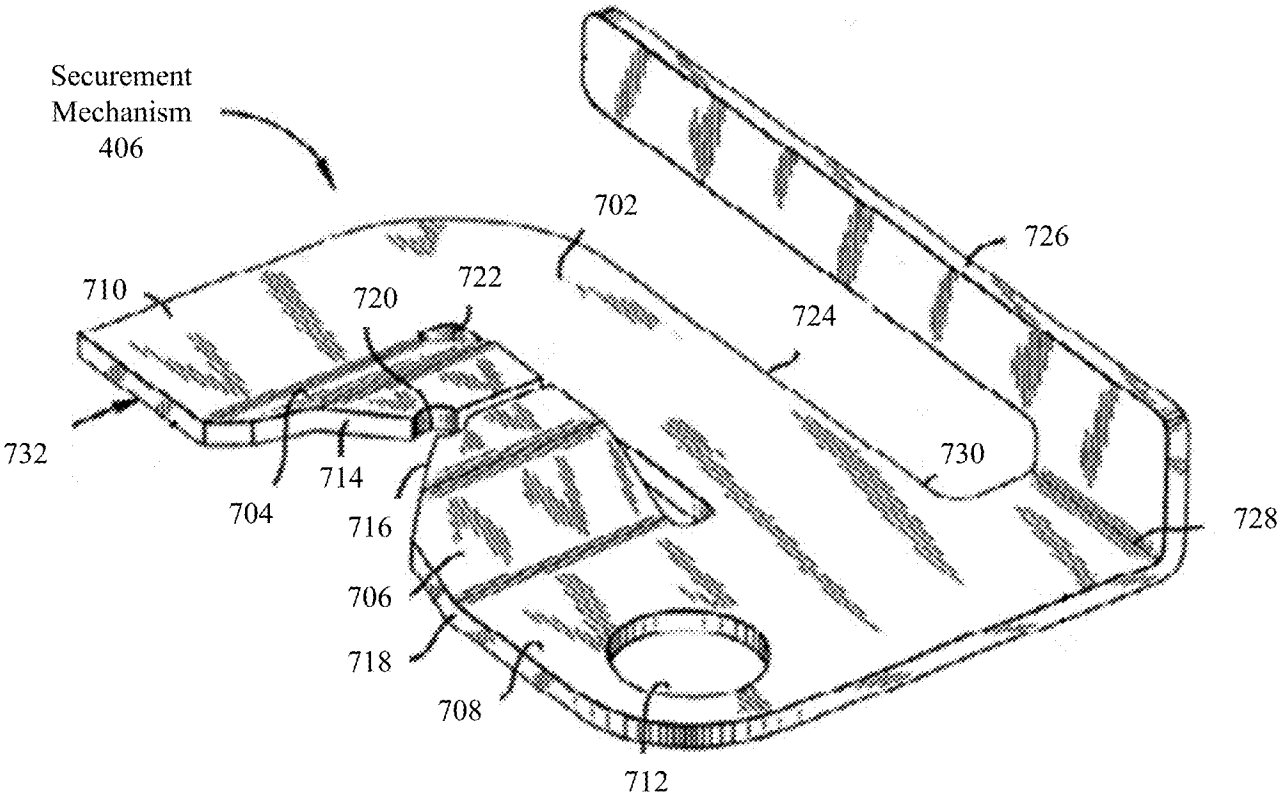
FIG. 7 (Prior Art)
FIG. 7 is a perspective view of a securement mechanism of the conventional security tag shown in FIG. 3-6.
Figure 8:
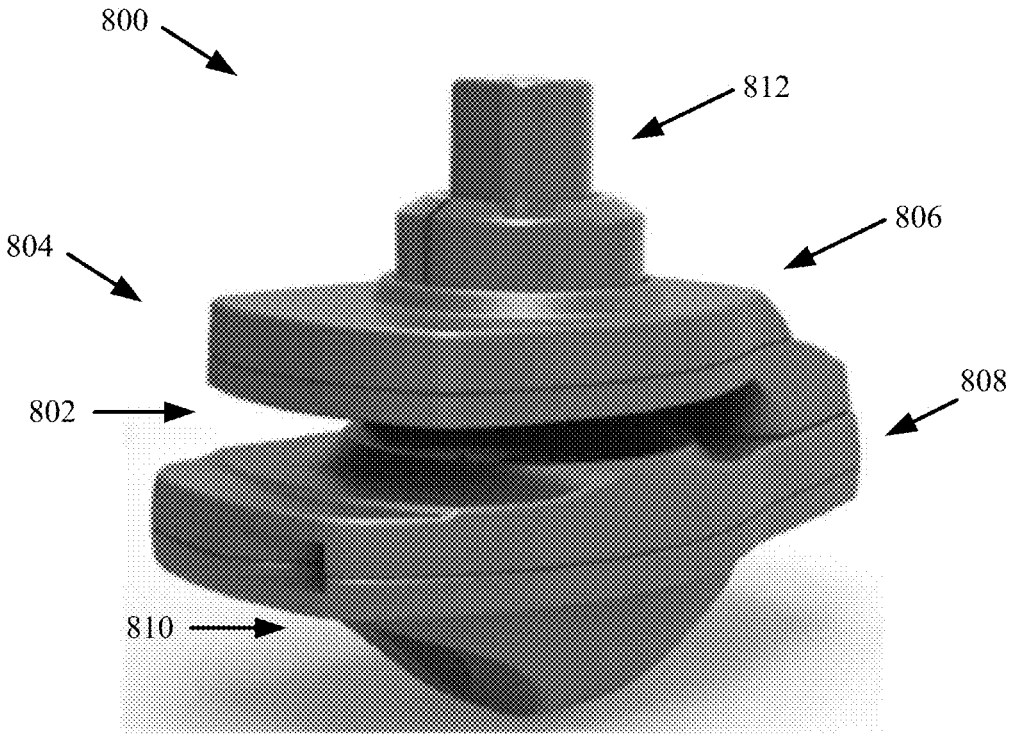
FIG. 8 is a front perspective view of a security tag in accordance with the present solution.
Figure 9:
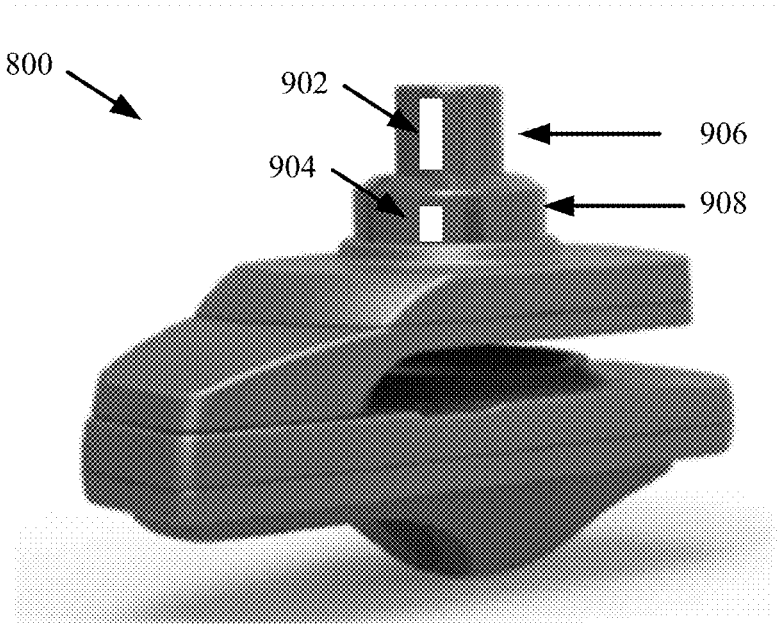
FIG. 9 is a rear perspective view of the security tag shown in FIG. 8.
Figure 10:
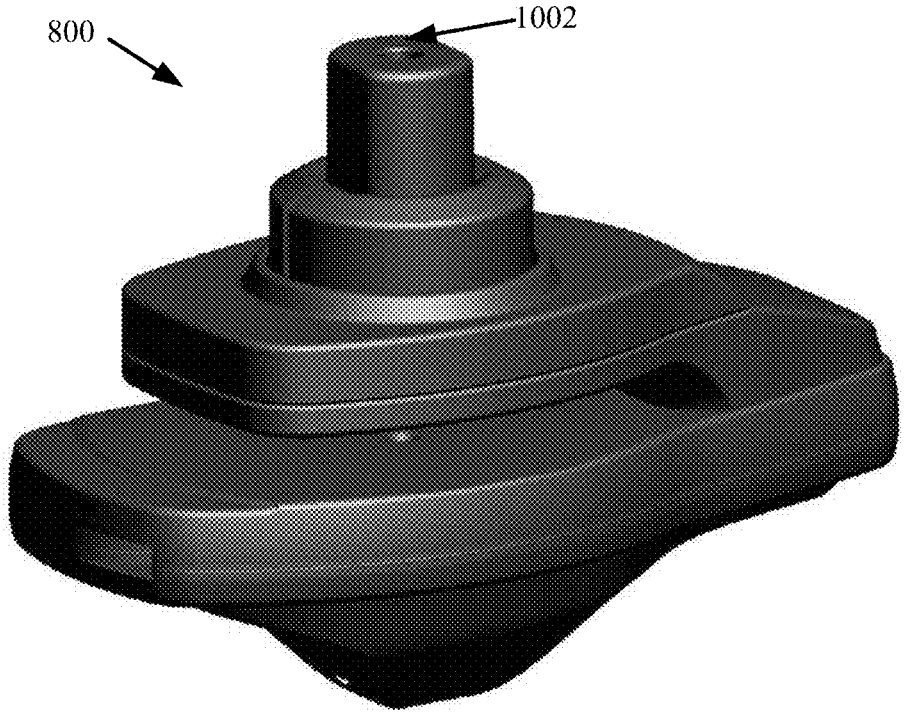
FIG. 10 is a side perspective view of the security tag shown in FIG. 8.
Figure 11:
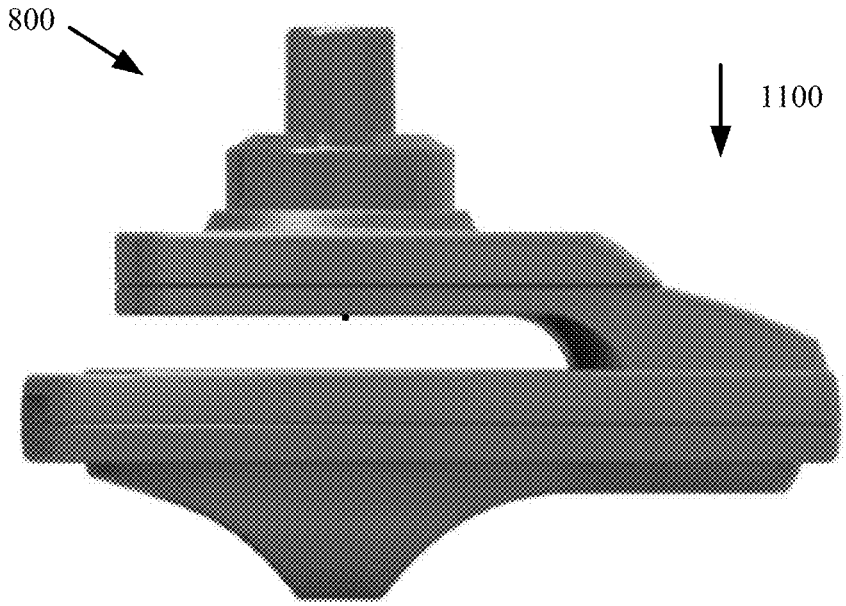
FIG. 11 is a side view of the security tag shown in FIG. 8 with a telescoping push button in an unengaged position.

A schematic illustration of the securement mechanism 406 is provided in FIG. 7. As noted above, the securement mechanism 406 is specifically adapted to accommodate release of the tack body 402 via the detachment mechanism 302 (or arcuate probe) moving in the arcuate channel 502. The securement mechanism 406 is generally in the form of a spring clamp securely disposed within the housing 304 of the security tag so as to be pivotable (or rotatable) about an axis 408. In this regard, the spring clamp comprises a clamp body 702 and jaws 704, 706. The clamp body 702 includes a mounting part 708 extending laterally of jaw 706 and a release part 710 extending laterally of jaw 704. The mounting part 708 includes a mounting aperture 712 facilitating the pivotable movement of the securement mechanism 406 within the housing of the security tag. The pivotable movement allows the securement mechanism 406 to be transitioned by the detachment mechanism 302 (or arcuate probe) from a first position in which the tack assembly is locked thereto (as shown in FIG. 5) and a second position in which the tack assembly is released or unlocked therefrom (as shown in FIG. 6).

Each of the jaws 704, 706 extends outwardly of the plane of the clamp body 702 and then inwardly toward the other jaw. The jaws 704, 706 terminate in facing edges 714, 716. These edges extend from a common edge 718 of the clamp body 702 inwardly toward each other, then curve outwardly away from each other to define an aperture 720 (typically, circular or elliptical) for receiving the tack body 402. The edges 714, 716 then continue in aligned fashion and end in an elongated, lateral slot 722 in the clamp body 702. The lateral slot lies inward of a further clamp body edge 724 which opposes the clamp body edge 718.

A further laterally extending elongated spring sleeve 726 is attached by a joint area 728 to the side 730 of the edge 724 bordering the mounting part 708. The sleeve 726 extends along the length of the edge 724 and is also out of the plane of the clamp body 702.

For mounting and supporting the spring clamp 702, the lower housing member 308 of the security tag 300 includes a circular mount 602. The spring clamp 502 is mounted, via aperture 512 of the mounting part 508, on the circular mount 602. In this way, the mounting part 708 can be rotated about the circular mount 602. The spring clamp 702 is thus able to pivot about the mounting part 708.

When an end of the tack assembly 310 is introduced in the downward direction through the opening 404 in the upper housing member 306, the tack body 404 is directed to aperture 720 of the securement mechanism 406. This causes the jaws 704, 706 to spread open and allow the tack body 404 to pass there through.

When the downward movement of the tack assembly 310 is stopped, the jaws 704, 706 retract and clutch the tack body 404. In this position, the jaws 704, 706 prevent upward movement of the tack assembly 310. As such, the security tag 300 becomes securely coupled to the article 314.

In order to release the tack body 404 from the jaws 704-706, the detachment mechanism 302 is introduced into the insert space 316 formed in the housing 304 of the security tag 300. Rotation of the detachment mechanism 302 causes it to be moved in and guided by the arcuate channel 502 until the end 318 abuts portion 732 of the securement mechanism 406. Continued rotational movement of the detachment mechanism 302 causes force to be applied to portion 732 of the securement mechanism 406. This force, in turn, causes the clamp body 702 to rotate about the support area 708. The jaw 704 is thus enabled to spread away from jaw 706 due to the force of the tack body 404, which is being held stationary by jaw 706. As a result, aperture 720 expands, releasing the tack body 504 from the clutch of the jaws. The tack assembly 310 can now be moved in the upward direction past the jaws, via an upward force on the tack head 312.

During rotation of the clamp body 702, the spring sleeve 726 at the joint area 728 is compressed. After the tack assembly 310 is separated from the housing 304, the detachment mechanism 302 is rotated in the reverse direction. This reverse rotation disengages the detachment mechanism 302 from the securement mechanism 406. Consequently, the spring sleeve 726 rotates in an opposite direction so as to be brought back to its original position. Thereafter, the detachment mechanism 302 is guided out of the arcuate channel 502 and is removed from insert space 316 formed in the housing 304.

As evident from the above discussion, the detachment mechanism 302 is provided to deflect the securement mechanism 406 so as to allow the tack assembly 310 to be removed from the housing 304. The detachment mechanism 302 may be part of an external detacher. Detachers are well known in the art, and therefore will not be described herein. When the tack assembly 310 is removed from the housing 304, the security tag 300 can be decoupled from an article 314 (e.g., a piece of clothing).

The deflection of the securement mechanism 406 results from an application of mechanical energy by the detachment mechanism 302. The present invention provides a means for harnessing the applied mechanical energy. The means includes an additional element disposed between the securement mechanism and EAS/RFID component(s). The additional element can include, but is not limited to, a piezo (or piezoelectric) element, a magnet/solenoid element, and/or a MEMS device.

Illustrative Physical Structures of Novel Tags

Referring now to FIGS. 8-15, there are provided illustrations of an illustrative physical structure of a tag 800 in accordance with the present solution. The security tags 112, 118 of FIG. 1 and 200 of FIG. 2 can have the same or similar physical structure as tag 800. As such, the discussion of tag 800 is sufficient for understanding the physical structures of security tags 112, 118 of FIG. 1 and 200 of FIG. 2.

The tag 800 includes a housing 804 with an upper housing member 806 joined to a lower housing member 808. The housing members 806, 808 can be joined together via an adhesive, a mechanical coupling means (e.g., snaps, screws, etc.), or a weld (e.g., an ultrasonic weld) so as to form a unitary piece. The housing 804 can be made from a rigid or semi-rigid material, such as plastic. Various electronic components are contained within the housing 804. For example, the electronic components are disposed in portion 810 of the lower housing member 808. These electronic components include, but are not limited to, all or some of the electronic components 202-216, 230-240, 244-250 of FIG. 2.

The housing 804 has an insert space 802 formed between the upper and lower housing members 806, 808. The insert space 802 is sized and shaped to receive at least a portion of an article (e.g., a piece of clothing). When inserted into the insert space 802, the tag 800 can be secured to the article via a retractable pin 1302. Notably, the retractable pin 1302 is integrated into the body of the tag 800. In order to secure the tag to the article, the retractable pin 1302 is urged in a downward direction 1100 from an unengaged position shown in FIGS. 11 and 14 to an engaged position shown in FIGS. 13 and 15. When in the unengaged position, the pin 1302 is retracted into the upper housing member 806. When in the engaged position, the pin 1302 extends through the insert space 802 and into the lower housing member 808. The housing 804 has an opening 1304 formed therein such that at least a portion of a retractable pin 1302 (or attachment element) can be inserted into the lower housing member 808 for facilitating the attachment of the security tag to an article.

A free end 1502 of the retractable pin 1302 can be secured inside the lower housing member 808 via a securement mechanism 1504. The securement mechanism 1504 is the same as or similar to the securement mechanism 406 discussed above in relation to FIGS. 4-7. The above discussion of securement mechanism 406 is sufficient for understanding securement mechanism 1504.

Figure 12:
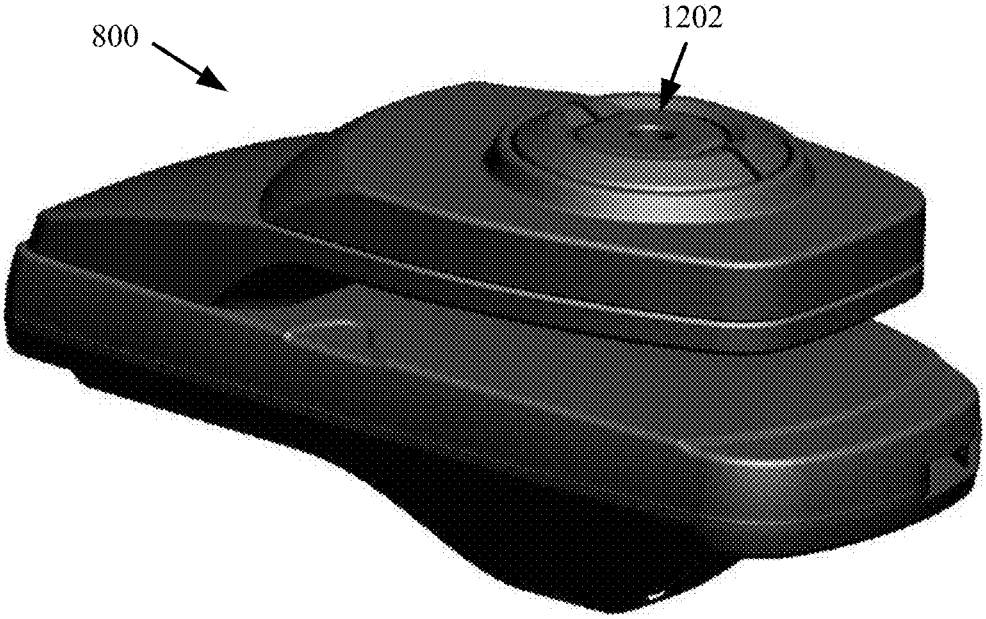
FIG. 12 is side view of the security tag shown in FIG. 8 with a telescoping push button in an engaged position.
Figure 13:
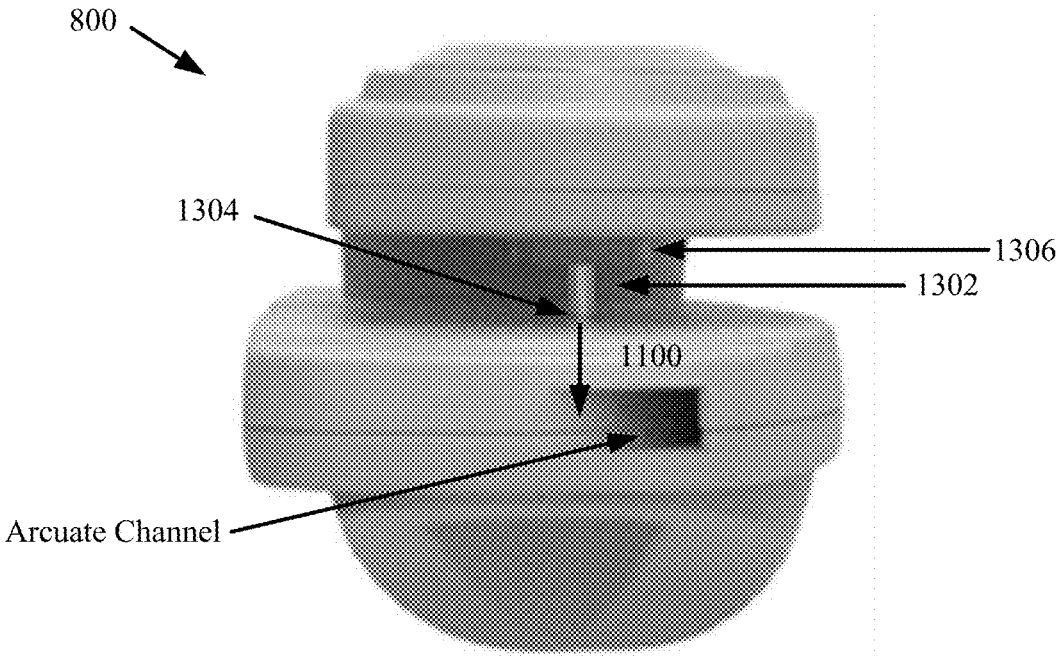
FIG. 13 is front view of the security tag shown in FIG. 8 with a telescoping push button in an engaged position.

The transition of the pin 1302 from the unengaged position to the engaged position is achieved via a telescoping actuator 812. An end 1404 of the pin 1302 is secured to the telescoping actuator 812 such that the pin moves in the downward direction 1100 when the telescoping actuator 812 is depressed by an operator. This securement can be achieved, for example, via an adhesive or mating threads. An illustration of the telescoping actuator 812 in its undepressed position is shown in FIGS. 8-11 and 14, and an illustration of the telescoping actuator 812 in its depressed position is shown in FIGS. 12-13 and 15.

The housing 804, insert space 802, and retractable pin assembly 812, 1302 are configured and arranged to maintain the pin's free end 1502 (which may be sharp) in a safe position at all times to prevent external exposure thereof. To accomplish this, the insert space 802 is narrow enough to prevent human fingers from entering the area proximate to the pin 1302. In effect, the tag advantageously has an improved safety feature both for users who attach the tag to an article and others who might encounter the tag in an unattached state. Since the pin is integral to the tag body, the issue of possible injury due to pin exposure is eliminated.

Figure 14:
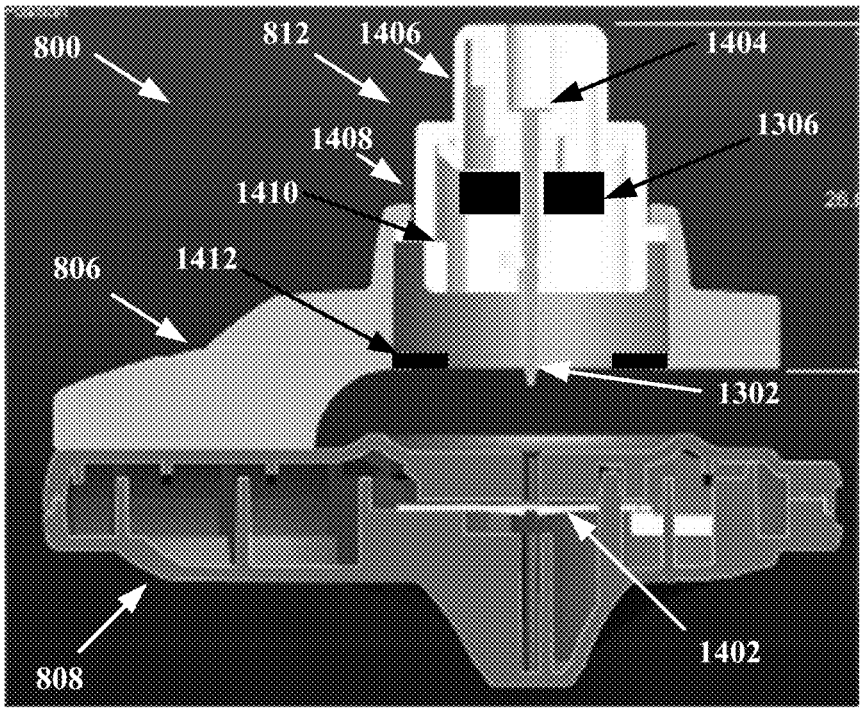
FIGS. 14-15 provide cross-sectional views of the tag shown in FIGS. 8-13.
Figure 15:
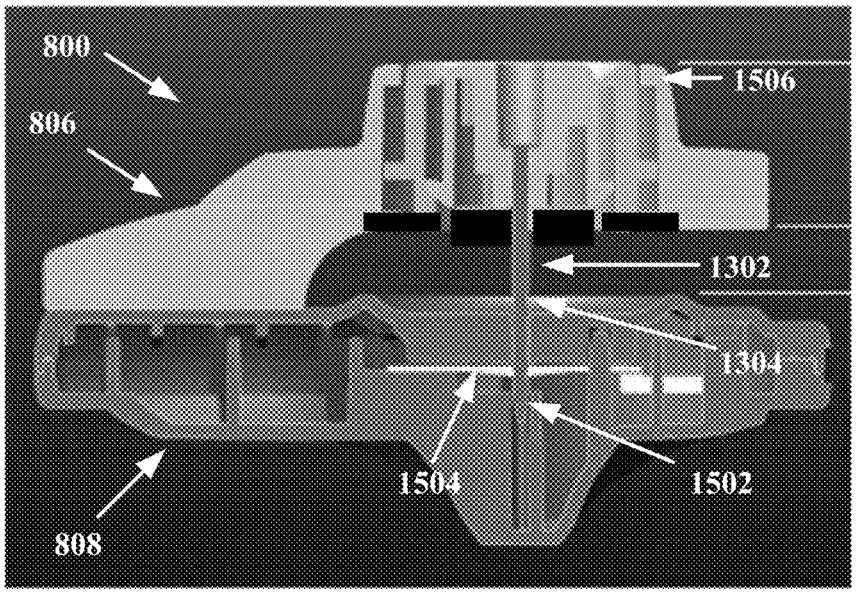

As shown in FIGS. 14-15, the telescoping actuator 812 comprises a first part 1406 securely coupled to a second part 1408 in a way that allows the actuator 812 to be smaller via depression thereof so as to provide minimal interference with a person's inspection of the article having the tag coupled thereto. In this regard, the first part 1406 is configured to slidingly engage the second part 1408 such that it can slide into the second part and slide out of the second part. When slid out of the second part, the first part 1406 extends therefrom in a direction away from the tag. When slid into the second part, the first part 1406 resides therein. A stop structure 1410 is provided on an inner surface of the second part 1408 for limiting the distance that the first part 1406 can travel in the downward direction 1100 relative to at least the second part 1408. This stop structure 1410 also provides a means for causing the second part 1408 to travel along with and in conjunction with the first part 1406 in the downward direction 1100.

The second part 1408 is coupled to the tag's housing 804. The second part 1408 is configured to slidingly engage the tag's housing 804 such that it can slide into the tag's housing and slide out of the tag's housing. When slid out of the tag's housing, the second part 1408 extends therefrom in a direction away from the tag. When slid into the tag's housing, the second part 1408 resides therein. A stop structure 1412 is provided on an inner surface of the tag's housing for limiting the distance that the second part 1408 can travel in the downward direction 1100 relative to at least the tag's housing. Another stop structure 1506 is also provided to limit the distance that the second part 1408 can travel in the upward direction relative to at least the tag's housing. The stop structures 1412, 1506 also provide a means for ensuring that the telescoping actuator does not become dislodged from the tag's housing during use thereof.

Notably, the telescoping actuator 812 may be resiliently biased (e.g., via a spring not shown in FIGS. 8-15) in a direction away from the tag's housing so that it automatically returns to its undepressed position when the pin's free end 1502 is released from the securement mechanism 1504 (e.g., in the manner described above in relation to FIGS. 4-7). The telescoping actuator 812 also has multiple purposes of (1) facilitating the securement of the security tag to an article, (2) providing an indication of a state of the pin's mechanical securement (e.g., successfully secured or released), and/or (3) providing an indication to the operator that the tag can now be decoupled from the article because the pin has been successfully released. These indications are provided auditorily, visually and/or tactually.

The visual indication can be provided simply by the telescoping actuator being placed in its fully depressed state and/or returned to its undepressed state. Alternatively or alternatively, the visual indication is provided via a marking and/or texture 902, 904 formed on or coupled to at least one surface 906, 908 of the telescoping actuator 812. The marking can include, but is not limited to, a colored line or other shape. The texture can include, but is not limited to, protrusions and/or dimples. A visual indication that the tag has been successfully secured to an article is provided when the marking and/or texture are no longer visible to the operator. In contrast, a visual indication the tag can now be decoupled from the article is provided when the marking and/or texture are once again visible to the operator. The visual indication can alternatively or additionally be provided via a post 1202 that fills an aperture 1002 when the telescoping actuator 812 is in its depressed position, and not when the telescoping actuator 812 is in its undepressed position. The post 1202 may also provide a tactile indication to the operator of a successful securement of the pin.

As shown in FIGS. 13-15, the telescoping actuator 812 is designed so that a shoulder member 1306 extends into the insert space 802 when it is in its depressed position. This shoulder member 1306 provides: (A) a means to prevent a person's ability to cut, break or deform the pin 1302 when the tag 800 is in use; (B) a means to protect damage to the article; and/or (C) a means to selectively adjust the size of the insert space. In scenario (B), shoulder member 1306 is at least partially formed of a deformable material (such as rubber or foam) or has a deformable material coupled to an engagement surface thereof (e.g., a pad coupled to a bottom surface thereof that is to come in contact with an article).

The tag's design significantly improves usability for automatic detaching arrangements. The new tag design does not require any interpretation of when the article is ready for removal during a detaching process. The pin is not required to be separately removed within a specified dwell time. Once the detacher probe or hook (e.g., detachment mechanism 302 of FIG. 3) releases the securement mechanism, the operator is provided with visual and/or auditory feedback that the detaching process has completed (the pin will retract within the housing automatically to provide easy removal of the article from insert space).

Figure 16:
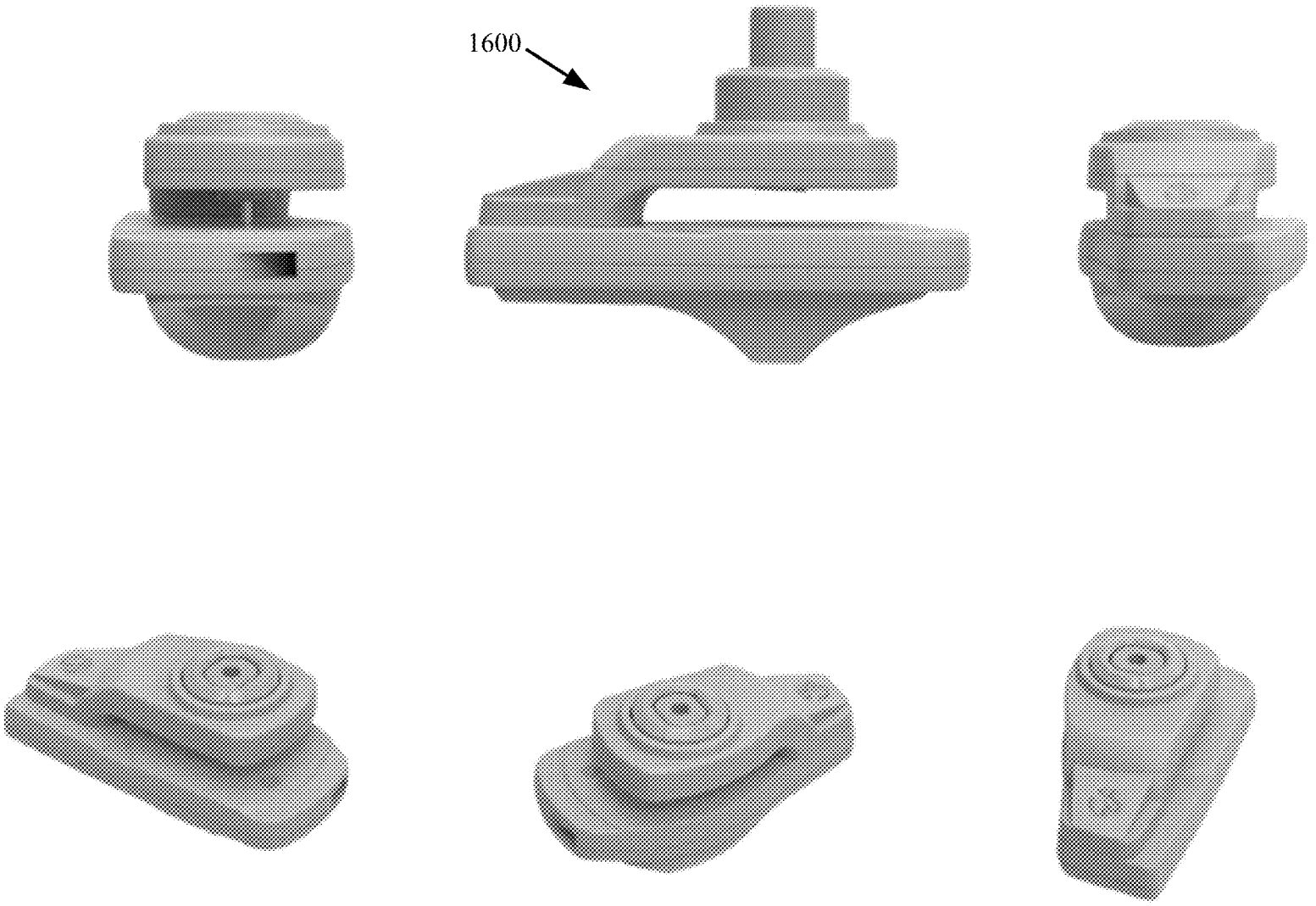
FIG. 16 provides illustrations showing another security tag architecture in accordance with the present solution.
Figure 17:
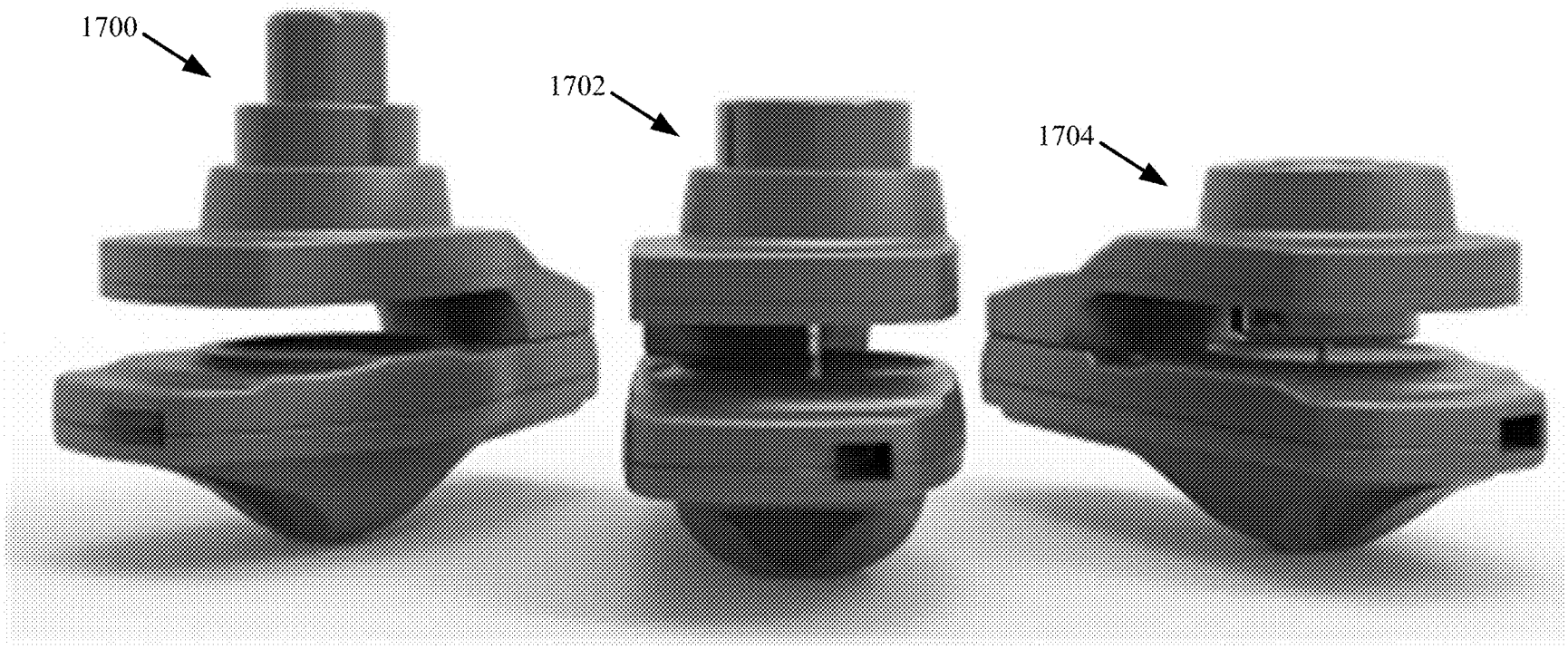
FIG. 17 provides front perspective views of other security tag architectures in accordance with the present solution.

The present solution is not limited to the physical design shown in FIGS. 8-15. For example, the pin can be designed such that it does not extend into the lower housing member when in its fully engaged position. In this case, the securement mechanism is eliminated from the tag. Other illustrative tag designs are shown in FIGS. 16 and 17. The tags of FIGS. 16-17 generally operate in the same manner as that discussed above in relation to FIGS. 8-15. The main difference between the tags of FIGS. 16-17 and the tag of FIGS. 8-15 is the telescoping actuator dimensions.

In some scenarios, the tag is designed such that the insert space has an adjustable size. This adjustability allows the tag to accommodate articles with different thicknesses. The size of the insert space can be adjusted in accordance with a plurality of different means. For example, the insert space's size is adjusted by: moving the upper housing portion relative to the lower housing portion; or moving a portion of a telescoping actuator into the insert space (e.g., as shown in FIGS. 16-17).

Figure 18:
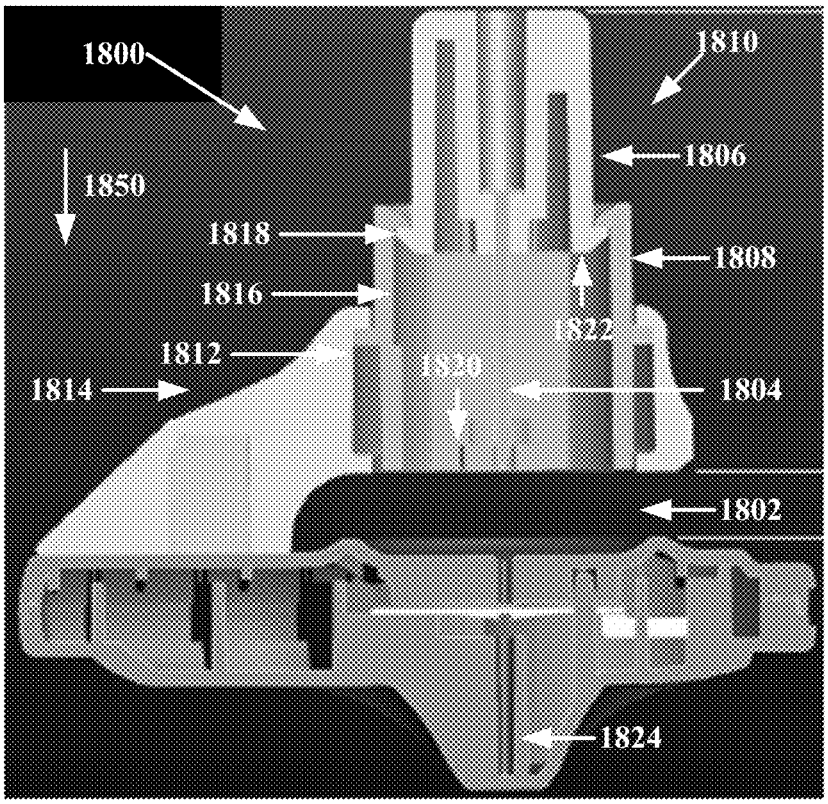
FIGS. 18-19 provide cross-sectional views of a security tag that are useful for understanding operations thereof.
Figure 19:
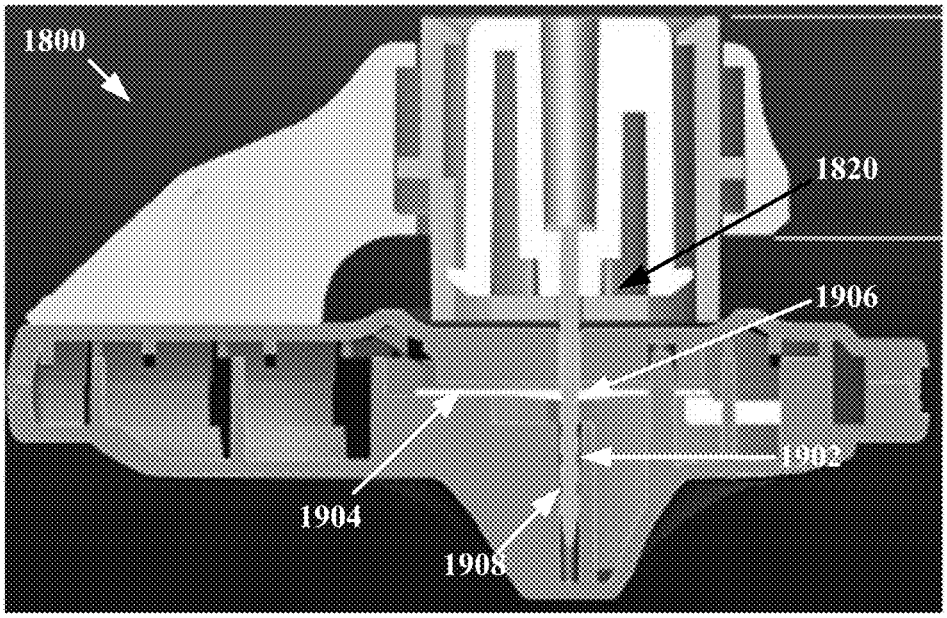

Referring now to FIGS. 18-19, there are provided cross-sectional diagrams of a tag 1800 which has a variable sized insert space 1802. The insert space's size is selectively varied via the pin and telescoping actuator assembly. The pin 1804 is coupled to a first part 1806 of a telescoping actuator 1810. This coupling is achieved via an adhesive, threads, or other coupling means. In effect, depression of the first part 1806 causes movement of the pin 1804 in the downward direction 1850.

The pin 1804 has a plurality of notches 1902 formed on its elongate body so as to be spaced apart from each other. The notches 1902 provide specific areas on the pin that can be engaged by the securement mechanism 1904. The specific notch that is engaged by the securement mechanism 1904 depends on the thickness of the article disposed in the insert space 1802. For example, a first notch 1906 is engaged by the securement mechanism 1904 when a relatively thin article is disposed in the insert space 1802 and provides resistance to further downward movement thereof. In contrast, a second notch 1908 is engaged by the securement mechanism 1904 when a relatively thick article is disposed in the insert space 1802 and provides resistance to further downward movement thereof.

The telescoping actuator 1810 is designed to be depressed into a smaller form as shown in FIG. 19. In this regard, the first part 1806 of the telescoping actuator 1810 is configured such that it slidingly engages an inner surface 1816 of the second part 1808. A second part 1808 of the telescoping actuator 1810 is configured such that it slidingly engages an inner surface 1812 of the tag's housing 1814. When a flange 1818 of the first part 1806 engages a bottom surface 1820 of the second part 1808, a downward pushing force is applied by the first part on the second part. In effect, the first and second parts travel together in the downward direction 1850. The second part is designed so that a portion thereof is able to extend into the insert space and is able to come in direct contact with the article disposed in the insert space. Consequently, the size of the insert space is adjusted to accommodate the actual thickness of the article. The first and second parts are maintained in the depressed positions through use of the pin 1804, notches 1902 and securement mechanism 1904.

In some scenarios, the first part 1806 is resiliently biased so that the telescoping actuator automatically returns to its undepressed position when the pin 1804 is released from the securement mechanism 1904 (e.g., in the manner described above in relation to FIGS. 3-7). In this regard, the first part may be resiliently biased by a resilient member (e.g., a spring not shown in FIGS. 18-19) disposed between a bottom surface 1822 of the first part 1806 and a bottom surface 1820 of the second part 1808.

In those or other scenarios, the pin 1804 is additionally or alternatively resiliently biased so that it automatically applies an upward pushing force on the first part 1806 when the pin 1804 is released from the securement mechanism 1904 (e.g., in the manner described above in relation to FIGS. 3-7). In this regard, the pin may be resiliently biased by a resilient member (e.g., a spring not shown in FIGS. 18-19) disposed in a channel 1824.

Figure 20:
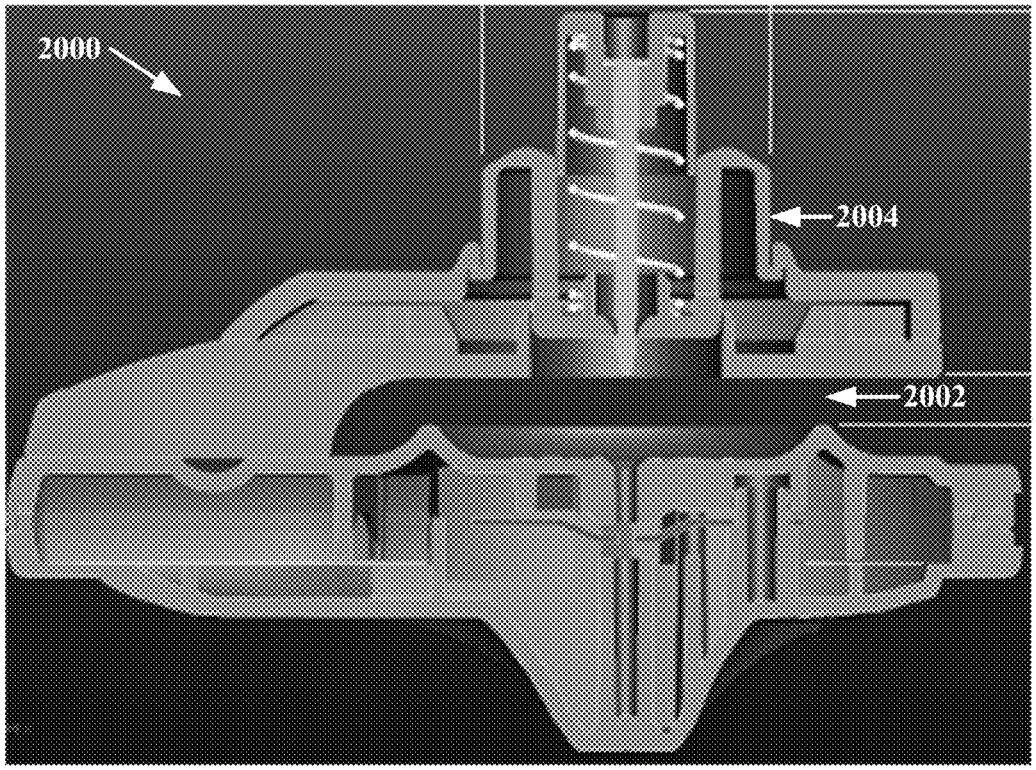
FIGS. 20-21 provide cross-sectional views of a security tag that are useful for understanding operations thereof.
Figure 21:
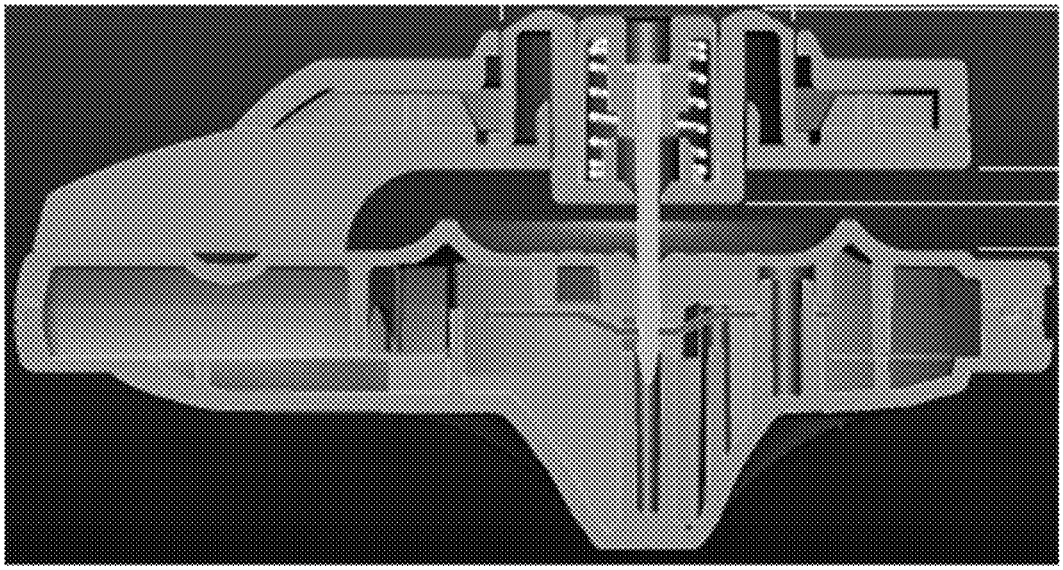

Referring now to FIGS. 20-21, there are provided cross-sectional diagrams of a tag 2000 which has a variable sized insert space 2002. The insert space's size is selectively varied via the pin and telescoping actuator assembly. The pin and telescoping actuator assembly is similar to that shown in FIGS. 18-19. The main difference between the two pin and telescoping actuator assemblies is the physical structure of the second parts 1808, 2004 and corresponding housing portions. The operation of the two pin and telescoping actuator assemblies are generally the same or substantially similar.

Figure 22:
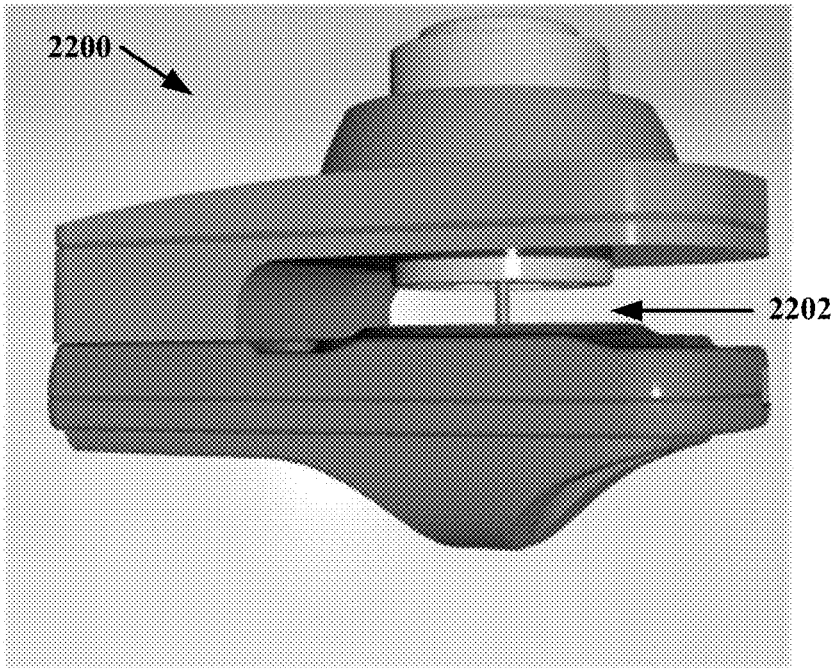
FIG. 22 provides a perspective view of a security tag in accordance with the present solution.
Figure 23:
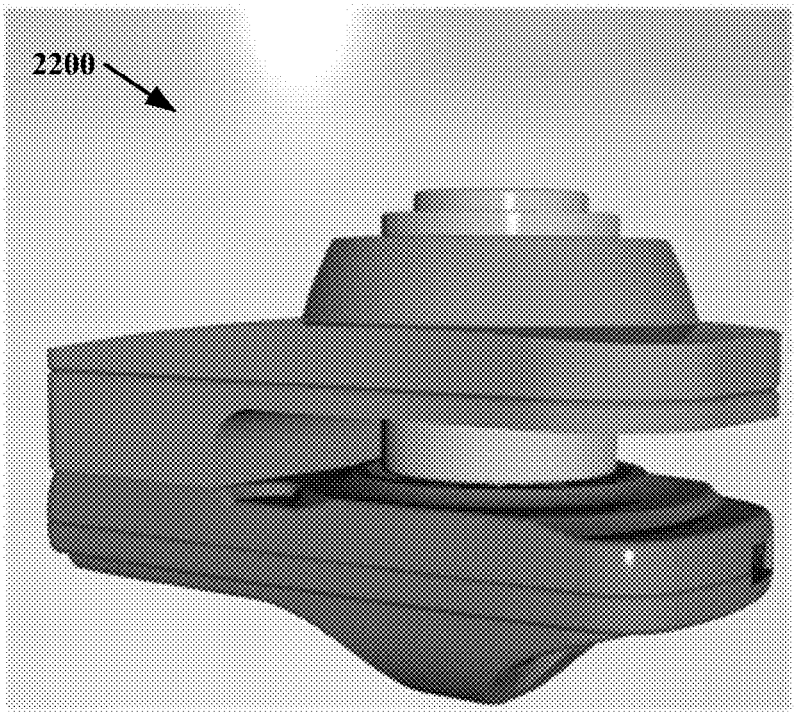
FIG. 23 provides a perspective view of the security tag shown in FIG. 22 with a telescoping push button in an engaged position.
Figure 24:
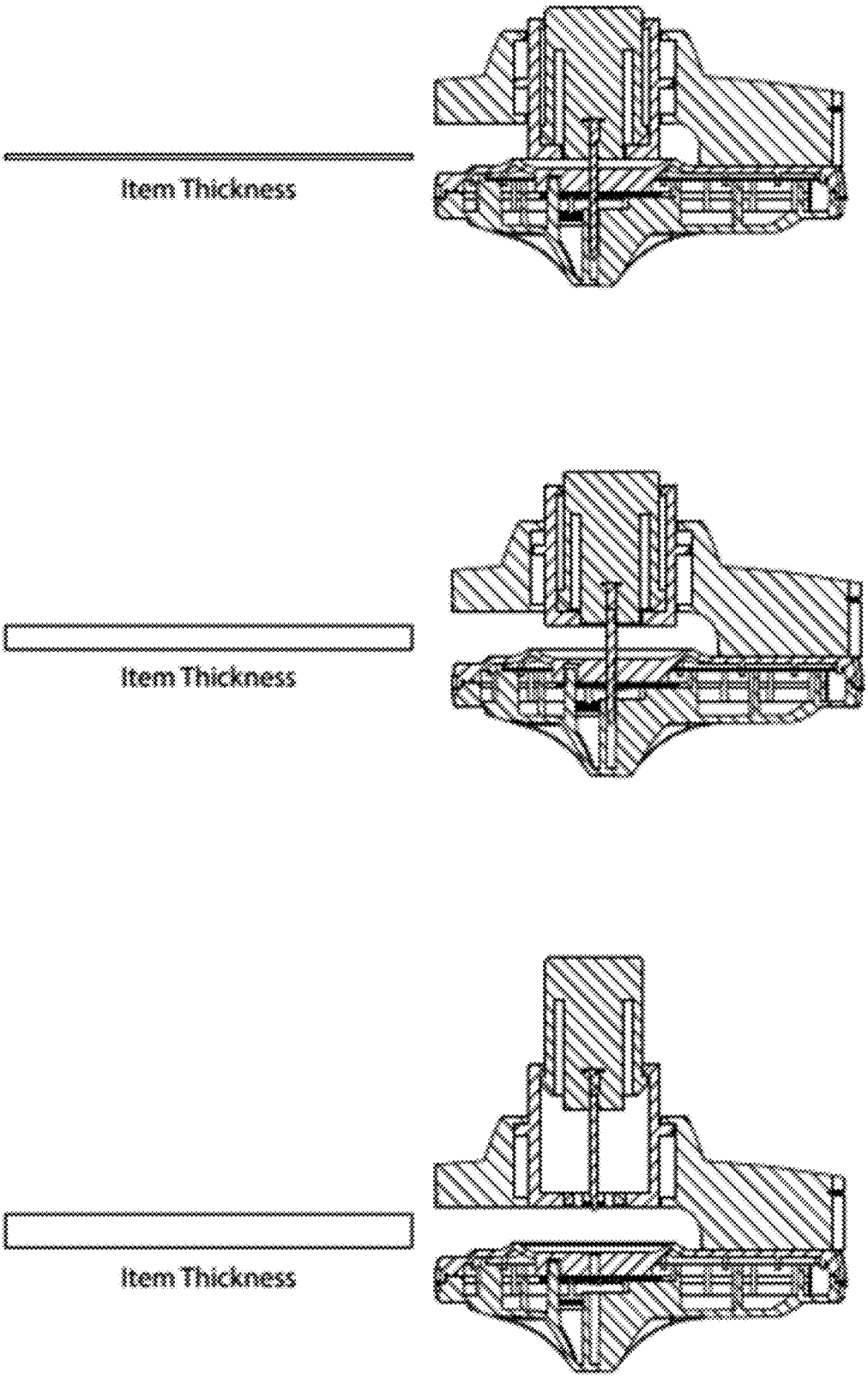
FIG. 24 provides illustrations of the security tag shown in FIGS. 22-23 in different states for accommodating items of different thicknesses.

Referring now to FIGS. 22-23, there are provided perspective views of a tag 2200 that is designed with an insert space 2202 having a size that can be adjusted in accordance with the teachings of FIGS. 18-21. FIG. 24 shows the tag 2200 accommodating items of different thicknesses.

Figure 25:
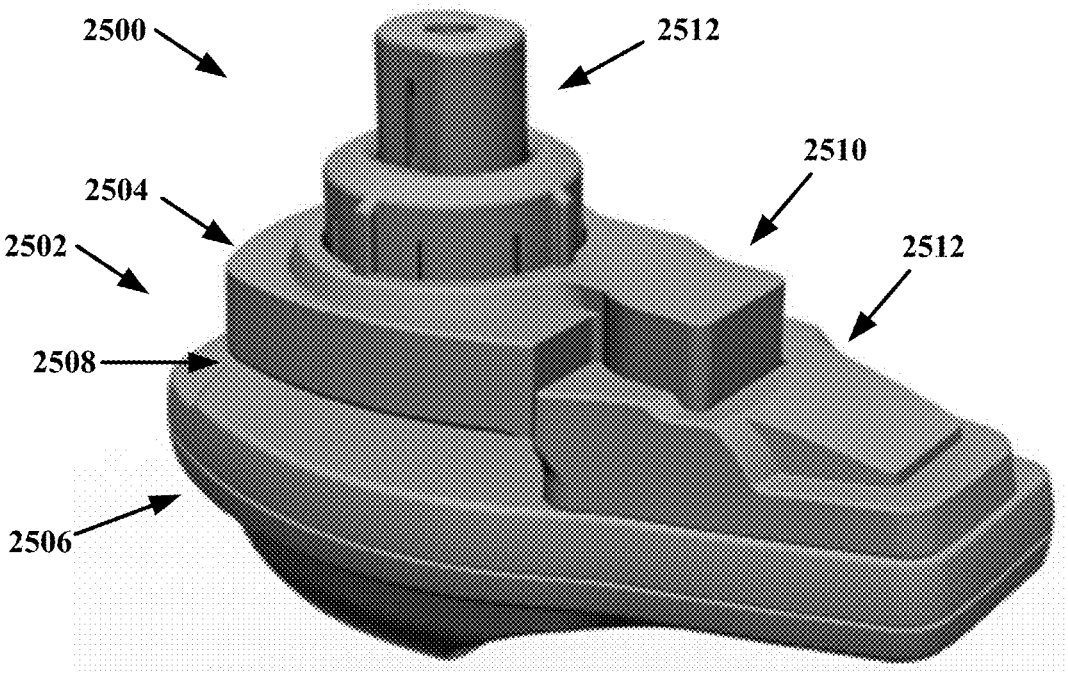
FIG. 25 provides a perspective view of a security tag in accordance with the present solution.
Figure 26:
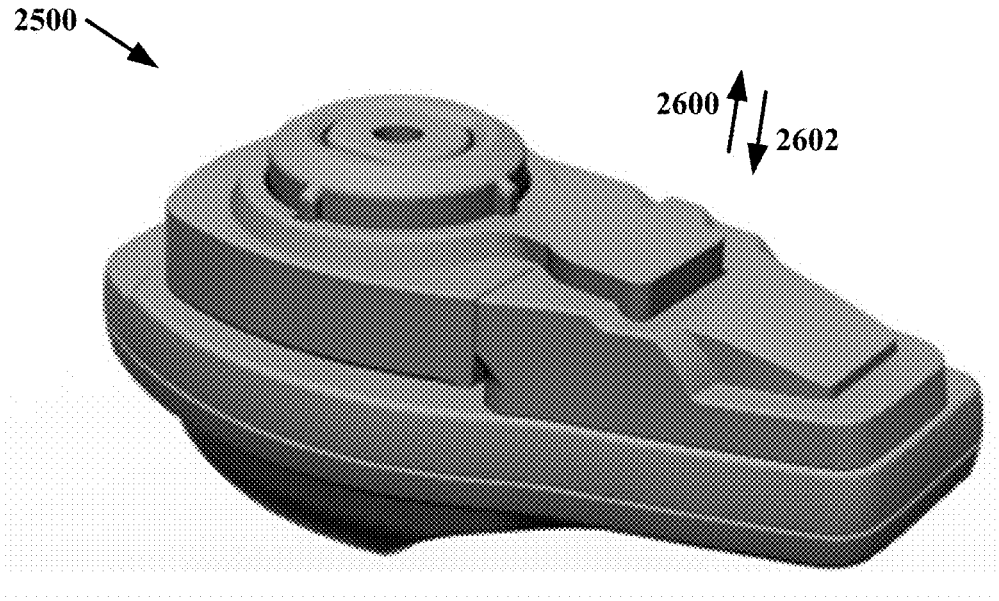
FIG. 26 provides a perspective view of the security tag shown in FIGS. 22-23 with a telescoping push button in an engaged position.

Referring now to FIGS. 25-26, there are provided illustrations showing a tag 2500 that is designed with an insert space 2508 having a size that can be adjusted by a different technique than that discussed above in relation to FIGS. 18-24. Tag 2500 comprises a housing 2502 having an upper portion 2504 and a lower portion 2506. The upper portion 2504 is movable relative to the lower portion 2506. For example, the upper portion 2504 is designed to have two components 2510, 2512 which slidingly engage each other. A first component 2512 is securely coupled to the lower portion 2506. A second component 2510 is configured to move in two opposing directions 2600, 2602 relative to the first component 2512 and the lower portion 2506. During operation, the second component 2510 is configured to move in the downward direction 2602 along with the telescoping actuator 2512 until it comes in direct contact with the article disposed in the insert space 2508. In this way, the size of the insert space 2508 can be selectively adjusted each time the tag 2500 is being coupled to an article. Accordingly, the tag 2500 is able to accommodate items with different thicknesses as shown in FIG. 27.

Figure 27:
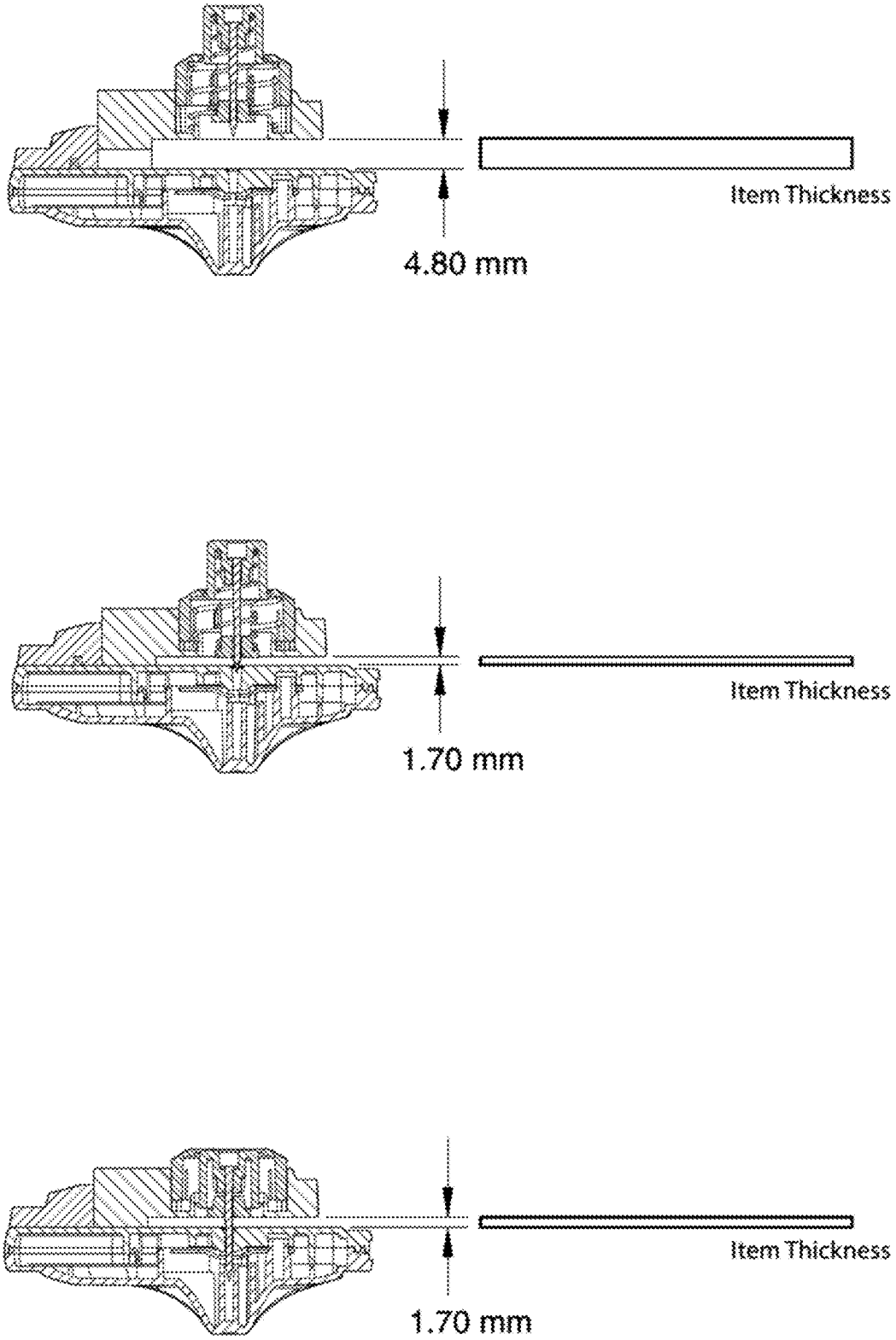
FIG. 27 provides illustrations of the security tag shown in FIGS. 25-26 in different states for accommodating items of different thicknesses.
Figure 28:
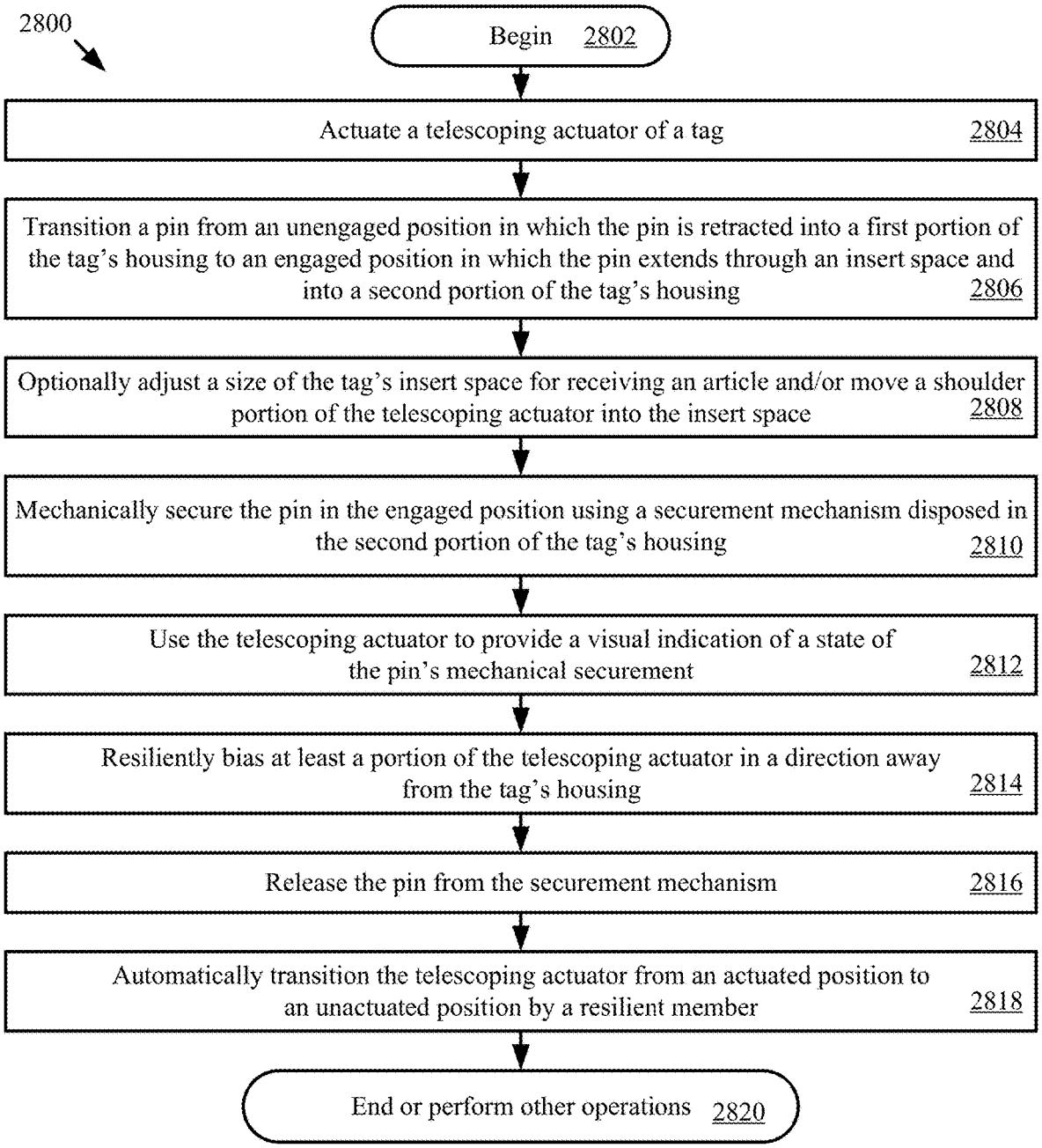
FIG. 28 is a flow diagram of an illustrative method for operating a security tag.

Referring now to FIG. 28, there is provided a flow diagram of an illustrative method 2800 for operating a tag (e.g., tag 112, 118 of FIG. 1, 200 of FIG. 2, 800 of FIGS. 8-15, 1600 of FIG. 16, 1700, 1702, 1704 of FIG. 17, 1800 of FIGS. 18-19, 2000 of FIGS. 20-21, 2200 of FIG. 22-24, or 2500 of FIGS. 25-27). Method 2800 begins with 2802 and continues with 2804 where a telescoping actuator (e.g., telescoping actuator 812 of FIG. 8, 1810 of FIG. 18, 2512 of FIG. 25) of the tag is actuated. As shown by 2806, this actuation causes a pin (e.g., pin 1302 of FIG. 13 or 1804 of FIG. 18) to transition from an unengaged position in which the pin is retracted into a first portion (e.g., upper housing member 806 of FIG. 8 or 2504 of FIG. 25) of the tag's housing (e.g., housing 804 of FIG. 8, 1814 of FIG. 18 or 2502 of FIG. 25) to an engaged position in which the pin extends through an insert space (e.g., insert space 802 of FIG. 8, 1802 of FIG. 18, 2002 of FIG. 20, or 2508 of FIG. 25) and into a second portion (e.g., e.g., lower housing member 804 of FIG. 8, 1814 of FIG. 18, or 2502 of FIG. 25) of the tag's housing. Notably, the pin is securely coupled to a movable component (e.g., first part 1406 of FIG. 14 or 1806 of FIG. 18) of the telescoping actuator so as to be integrated into the tag's body. The first and second portions of the tag's housing are coupled to each other so as to form a unitary piece. The telescoping actuator has a decreased size when the pin is in the engaged position.

Next in optional 2808, a size of the insert space is adjusted and/or a shoulder portion (e.g., shoulder portion 1306 of FIG. 13) coupled to the telescoping actuator is moved into the insert space. The insert space's size is adjusted by: moving a portion (e.g., portion 1306 of FIG. 13 or 1808 of FIG. 18) of the telescoping actuator into the insert space; or moving the first portion (e.g., portion 2510 of FIG. 25) of the tag's housing relative to the second portion (e.g., portion 2512 and/or 2506 of FIG. 25) of the tag's housing.

In 2810, the pin is mechanically secured in the engaged position using a securement mechanism (e.g., securement mechanism 406 of FIG. 4, 1504 of FIG. 15, or 1904 of FIG. 19) disposed in the second portion of the tag's housing. The telescoping actuator provides a visual indication of a state of the pin's mechanical securement, as shown by 2812. The visual indication is at least partially provided by a marking or texture applied to the telescoping actuator.

At least a portion of the telescoping actuator is resiliently biased in a direction away from the tag's housing, as shown by 2814. In this regard, the telescoping actuator automatically returns to its unactuated position when the pin is released from the securement mechanism, as shown by 2816-2818. Subsequently, 2820 is performed where method 2800 ends or other processing is performed.

Although the present solution has been illustrated and described with respect to one or more implementations, equivalent alterations and modifications will occur to others skilled in the art upon the reading and understanding of this specification and the annexed drawings. In addition, while a particular feature of the present solution may have been disclosed with respect to only one of several implementations, such feature may be combined with one or more other features of the other implementations as may be desired and advantageous for any given or particular application. Thus, the breadth and scope of the present solution should not be limited by any of the above described embodiments. Rather, the scope of the present solution should be defined in accordance with the following claims and their equivalents.

What is claimed is:

1. A method for operating a tag, comprising:

actuating a telescoping actuator of the tag to transition a pin from an unengaged position in which the pin is retracted into a first portion of the tag's housing to an engaged position in which the pin extends through an insert space and into a second portion of the tag's housing;

mechanically securing the pin in the engaged position using a securement mechanism disposed in the second portion of the tag's housing; and providing an indication of a state of the pin's mechanical securement by causing a post to fill an aperture formed in the telescoping actuator of the tag when the pin is in the engaged position and not in the unengaged position;

wherein the pin is securely coupled to a movable component of the telescoping actuator so as to be integrated into the tag's body;

wherein the first and second portions of the tag's housing are coupled to each other so as to form a unitary piece and at least a first part of the first portion of the tag's housing is unmovable relative to the second portion of the tag's housing; and wherein a size of the insert space is selectively adjusted by linearly moving the at least a second part of the first portion of the tag's housing relative to the second portion of the tag's housing.

2. The method according to claim 1, wherein the telescoping actuator has a dual purpose of (A) transitioning the pin between the engaged and unengaged positions and (B) providing a visual indication of a state of the pin's mechanical securement.

3. The method according to claim 2, wherein the visual indication is at least partially provided by a marking or texture applied to the telescoping actuator which is visible when the pin is in the unengaged position and no longer visible when the pin is in the engaged position.

4. The method according to claim 1, wherein the telescoping actuator has a decreased size when the pin is in the engaged position.

5. The method according to claim 1, further comprising resiliently biasing at least a portion of the telescoping actuator in a direction away from the tag's housing.

6. The method according to claim 1, further comprising automatically transitioning the telescoping actuator from an actuated position to an unactuated position by a resilient member when the pin is released from the securement mechanism.

7. The method according to claim 1, further comprising linearly moving a shoulder coupled to the telescoping actuator in a direction away from the first portion of the tag's housing and into the insert space for protecting a portion of the pin extending through the insert space.

8. A tag, comprising:

a housing;

a telescoping actuator coupled to the housing and configured to transition a pin from an unengaged position in which the pin is retracted into a first portion of the housing to an engaged position in which the pin extends through an insert space and into a second portion of the housing;

a securement mechanism disposed in the second portion of the tag's housing and configured to mechanically secure the pin in the engaged position; and a post that fills an aperture formed in the telescoping actuator of the tag when the pin is in one of the engaged position and the unengaged position;

wherein the pin is securely coupled to a movable component of the telescoping actuator so as to be integrated into the tag's body;

wherein the first and second portions of the tag's housing are coupled to each other so as to form a unitary piece and at least a part of the first portion of the tag's housing is unmovable relative to the second portion of the tag's housing; and wherein the size of the insert space is selectively adjusted by linearly moving the at least a part of the first portion of the tag's housing relative to the second portion of the tag's housing.

9. The tag according to claim 8, wherein the telescoping actuator has a dual purpose of (A) transitioning the pin between the engaged and unengaged positions and (B) providing a visual indication of a state of the pin's mechanical securement.

10. The tag according to claim 9, wherein the visual indication is at least partially provided by a marking or texture applied to the telescoping actuator which is visible when the pin is in the unengaged position and no longer visible when the pin is in the engaged position.

11. The tag according to claim 8, wherein the telescoping actuator has a decreased size when the pin is in the engaged position.

12. The tag according to claim 8, further comprising a resilient member resiliently biasing at least a portion of the telescoping actuator in a direction away from the housing.

13. The tag according to claim 12, wherein the resilient member facilitates an automatic transition of the telescoping actuator from an actuated position to an unactuated position when the pin is released from the securement mechanism.

14. The tag according to claim 8, further comprising an insert space formed between the first and second portions of the housing so as to have a selectively adjustable size.

15. The tag according to claim 8, further comprising a shoulder coupled to the telescoping actuator which is linearly movable into the insert space for protecting a portion of the pin extending through the insert space.

* * * * *